US008021535B2

(12) United States Patent
Bonhote et al.

(10) Patent No.: US 8,021,535 B2
(45) Date of Patent: Sep. 20, 2011

(54) METHODS FOR PLATING WRITE POLE SHIELD STRUCTURES WITH ULTRA-THIN METAL GAP SEED LAYERS

(75) Inventors: Christian Rene Bonhote, San Jose, CA (US); Quang Le, San Jose, CA (US); Xhavin Sinha, New Westminster (CA)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 936 days.

(21) Appl. No.: 12/005,556

(22) Filed: Dec. 26, 2007

(65) Prior Publication Data

US 2009/0166210 A1 Jul. 2, 2009

(51) Int. Cl.
*C25D 5/02* (2006.01)

(52) U.S. Cl. ... 205/122; 205/118; 360/110; 360/125.02; 360/125.03

(58) Field of Classification Search ..... 205/122; 360/125.02, 125.03
See application file for complete search history.

(56) References Cited

U.S. PATENT DOCUMENTS

| | | | | |
|---|---|---|---|---|
| 4,907,113 | A | 3/1990 | Mallary | |
| 5,744,019 | A | 4/1998 | Ang | |
| 5,805,392 | A | 9/1998 | Mallary et al. | |
| 5,901,432 | A | 5/1999 | Armstrong et al. | |
| 6,140,234 | A | 10/2000 | Uzoh et al. | |
| 6,514,393 | B1 | 2/2003 | Contolini et al. | |
| 6,540,928 | B1 | 4/2003 | Kobrin et al. | |
| 6,589,816 | B2 | 7/2003 | Napolitano | |
| 6,774,039 | B1 | 8/2004 | Drewery | |
| 6,807,027 | B2 | 10/2004 | McGeehin et al. | |
| 6,811,670 | B2 | 11/2004 | Liu et al. | |
| 6,861,355 | B2 * | 3/2005 | Marsh | 438/652 |
| 6,949,833 | B2 | 9/2005 | O'Kane et al. | |
| 7,037,574 | B2 | 5/2006 | Paranjpe et al. | |
| 7,052,922 | B2 | 5/2006 | Lindgren | |
| 2001/0022704 | A1 | 9/2001 | Hong | |
| 2006/0044682 | A1 * | 3/2006 | Le et al. | 360/126 |
| 2008/0149490 | A1 * | 6/2008 | Bonhote et al. | 205/183 |

OTHER PUBLICATIONS

Research Disclosure Document #33786, May 1992.
Research Disclosure Document #430108, Feb. 2000.

* cited by examiner

*Primary Examiner* — Harry D Wilkins, III
*Assistant Examiner* — Bryan D. Ripa
(74) *Attorney, Agent, or Firm* — D'Arcy H. Lorimer; Lorimer Labs

(57) ABSTRACT

Methods and structures for electroplating shield structures for perpendicular thin film write poles having ultra thin non-magnetic top gaps on the order of a few nanometers are disclosed. Ultra thin, conductive seed layers serve a dual purpose as both plating seed layer and non-magnetic top gap for the write pole. Due to reduced current carrying capacity of ultra thin seed layers, an additional thick seed layer is also employed to aid delivering plating current to regions near the pole.

17 Claims, 29 Drawing Sheets

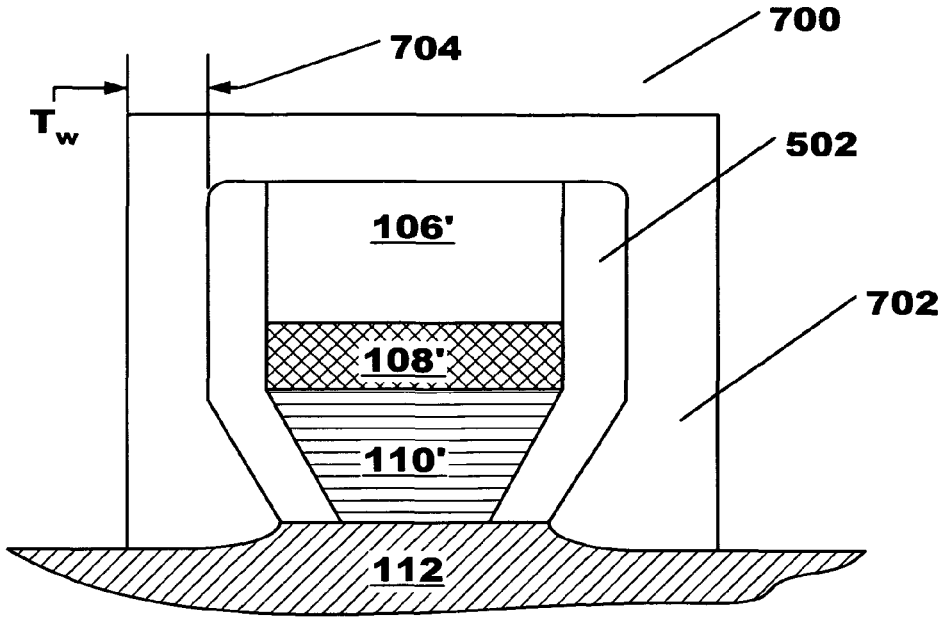
Figure 7
Figure 9
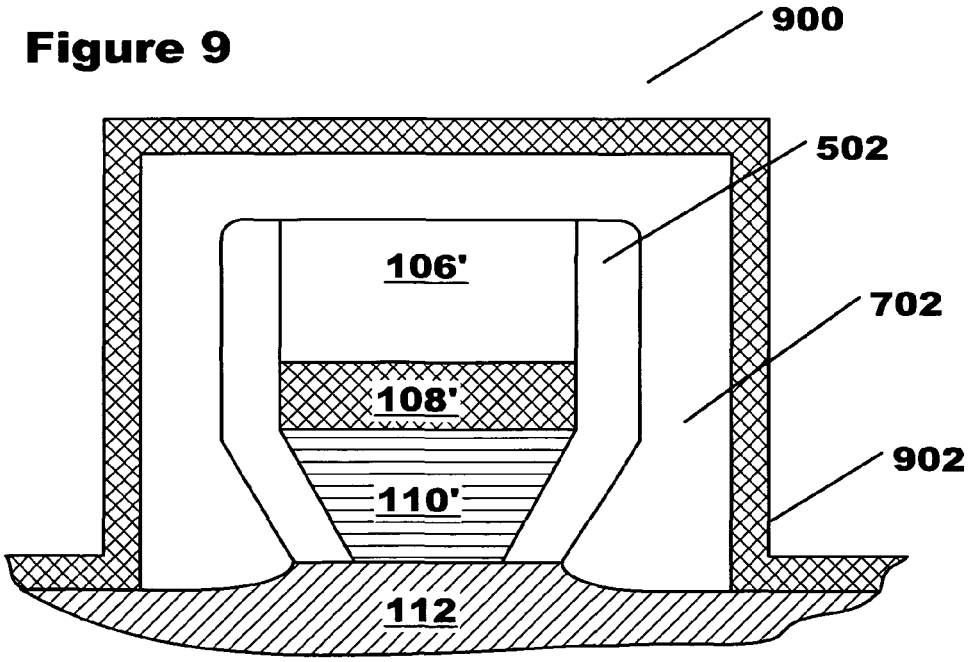

METHODS FOR PLATING WRITE POLE SHIELD STRUCTURES WITH ULTRA-THIN METAL GAP SEED LAYERS

BACKGROUND OF THE INVENTION

1. Field of the Invention

This invention relates to structures and methods for fabricating thin film perpendicular write heads. More specifically, the invention relates to structures and methods for fabricating wrap around and trailing shields using ultra-thin metal gap seed layers.

2. Description of the Related Art

Perpendicular write heads are currently well known in the art. Variants of such heads, having wrap around shields and trailing shields, have been recently disclosed. See, for example US Patent Application Publications 2005/0259355, 2006/0044682 and 2006/0174474, assigned to Hitachi Global Storage Technologies, Netherlands B.V.

During the fabrication of the wrap around shield of the prior art, a film stack containing the magnetic pole material, a non-magnetic gap layer, a CMP stop layer, and a number of image transfer layers are deposited. After the pole width is imaged and the film stack etched by a number of consecutive etch processes, a film stack containing the tapered pole material is created. A conformal non-magnetic layer is then deposited, which will serve as the side shield or wrap around shield gap material. Following deposition of the side gap material, a layer of RI-etch-able (or RIE-able, reactive ion etch-able) material is deposited and the structure planarized by CMP. Following planarization, the RI-etch-able material is removed leaving the tapered pole, main gap and side gap materials. A magnetic material is then deposited over this structure by electroplating to form the wrap around shield. Prior to plating, a conductive seed layer is deposited to provide a starting cathode for the plating process. As the main gap (or top gap) continues to shrink in thickness to dimensions of a few nanometers or less, the main gap layer is eliminated from the starting film stack, being replaced by the metallic, non-magnetic seed layer used to plate the wrap around shield. Difficulties arise when trying to plate on these ultra-thin seed layers due to their higher resistivity if plating dimensions exceed a few hundred microns. In structures of the prior art, the plating of all shield structures on a wafer is done from a single blanket seed layer. This is no longer possible for seed layers having a thickness of one to two nanometers and below.

During the formation of trailing shields of the prior art, a film stack containing the magnetic pole material, a non-magnetic gap layer, a CMP stop layer, and a number of image transfer layers are deposited. The pole width is imaged and the film stack etched by a number of consecutive etch processes, creating a film stack containing the tapered pole material. A filler layer is deposited and the resulting structure planarized by CMP to the stop layer. A plating seed layer is subsequently deposited, followed by deposition of the trailing shield. As with wrap around shields, thinner gap layers require substitution of the pre-deposited gap layer in the film stack with the ultra-thin non-magnetic seed layer. Plating of the trailing shields will experience the same difficulties described above for the wrap around shields.

What is needed is a better process for producing the wrap around and trailing shields for the perpendicular write head.

SUMMARY OF THE INVENTION

It is an object of the present invention to provide a method for making a perpendicular head including fabricating a write pole structure on a first portion of a surface, the write pole structure containing a write pole layer, fabricating a thick seed layer on a second portion of the surface, the thick seed layer having a boundary residing adjacent to the write pole structure, the boundary of the thick seed layer separated from the write pole structure by a distance T. The process further includes depositing an ultra-thin seed layer on the write pole layer, and on at least a portion of the thick seed layer, such that electrical continuity is established between the thick seed layer and the ultra-thin seed layer; and, electroplating a shield structure over the write pole layer by conducting electrical current from the thick seed layer to at least a portion of the ultra-thin seed layer, wherein the ultra-thin seed layer functions as a non-magnetic top gap between the write pole layer and the shield structure, the distance T being greater than the thickness of the thick seed layer, the distance T being less than 15 microns.

It is another object of the present invention to provide a method for making a perpendicular head including fabricating a write pole structure on a first portion of a surface, the write pole structure containing a write pole layer, enclosing at least a portion of the write pole structure within a photo-resist layer, subsequent to fabricating the write pole structure, depositing a thick seed layer on the photo resist layer and the second portion of the surface, removing the photo resist layer and a portion of the thick seed layer deposited on the photo resist layer, creating a thick seed layer boundary adjacent to the write pole structure, the boundary of the thick seed layer separated from the write pole structure by a distance T. The process further includes depositing an ultra-thin seed layer on the write pole layer, and on at least a portion of the thick seed layer, such that electrical continuity is established between the thick seed layer and the ultra-thin seed layer; and, electroplating a shield structure over the write pole layer by conducting electrical current from the thick seed layer to at least a portion of the ultra-thin seed layer, wherein the ultra-thin seed layer functions as a non-magnetic top gap between the write pole layer and the shield structure, the distance T being greater than the thickness of the thick seed layer, the distance T being less than 15 microns.

It is another object of the present invention to provide a method for making a perpendicular head including fabricating a write pole structure on a first portion of a surface, the write pole structure containing a write pole layer, enclosing at least a portion of the write pole structure within a photo-resist layer, subsequent to fabricating the write pole structure, depositing a thick seed layer on the photo resist layer and the second portion of the surface, the thick seed layer having a thickness between 100 m and 500 nm, removing the photo resist layer and a portion of the thick seed layer deposited on the photo resist layer, creating a thick seed layer boundary adjacent to the write pole structure, the boundary of the thick seed layer separated from the write pole structure by a distance T. The process further includes depositing an ultra-thin seed layer on the write pole layer, and on at least a portion of the thick seed layer, such that electrical continuity is established between the thick seed layer and the ultra-thin seed layer, the ultra-thin seed layer having a thickness between 1 nm and 3 nm; and, electroplating a shield structure over the write pole layer by conducting electrical current from the thick seed layer to at least a portion of the ultra-thin seed layer, wherein the ultra-thin seed layer functions as a non-magnetic top gap between the write pole layer and the shield structure, the distance T being greater than the thickness of the thick seed layer, the distance T being less than 15 microns.

BRIEF DESCRIPTION OF THE DRAWINGS

The present invention will be better understood when consideration is given to the following detailed description thereof. Such description makes reference to the annexed drawings, wherein:

FIG. 7 is a partial cross section view of the structure of FIG. 6 subsequent to the formation of photo resist feature 702, in accordance with an embodiment of the present invention;

FIG. 9 is a partial cross section view of the structure of FIG. 7 subsequent to the blanket deposition of thick seed layer 902, in accordance with an embodiment of the present invention;

DETAILED DESCRIPTION OF THE PREFERRED EMBODIMENTS

Figure 36:
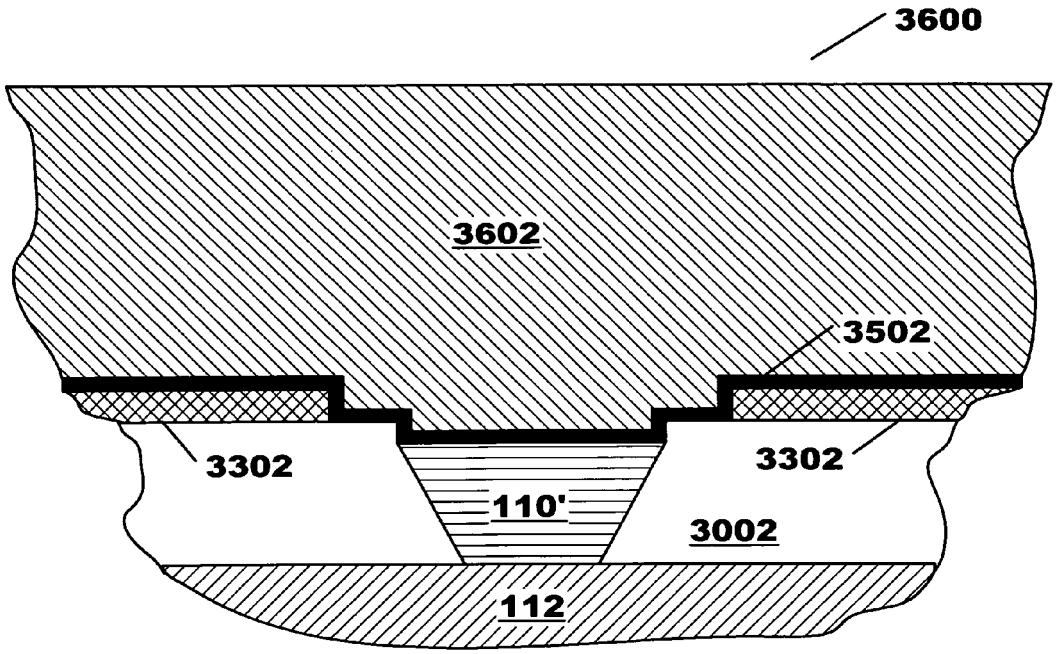
FIG. 36 is a partial cross section view of the structure of FIG. 34 subsequent to the electroplating of trailing shield 3602, in accordance with an embodiment of the present invention.
Figure 37:
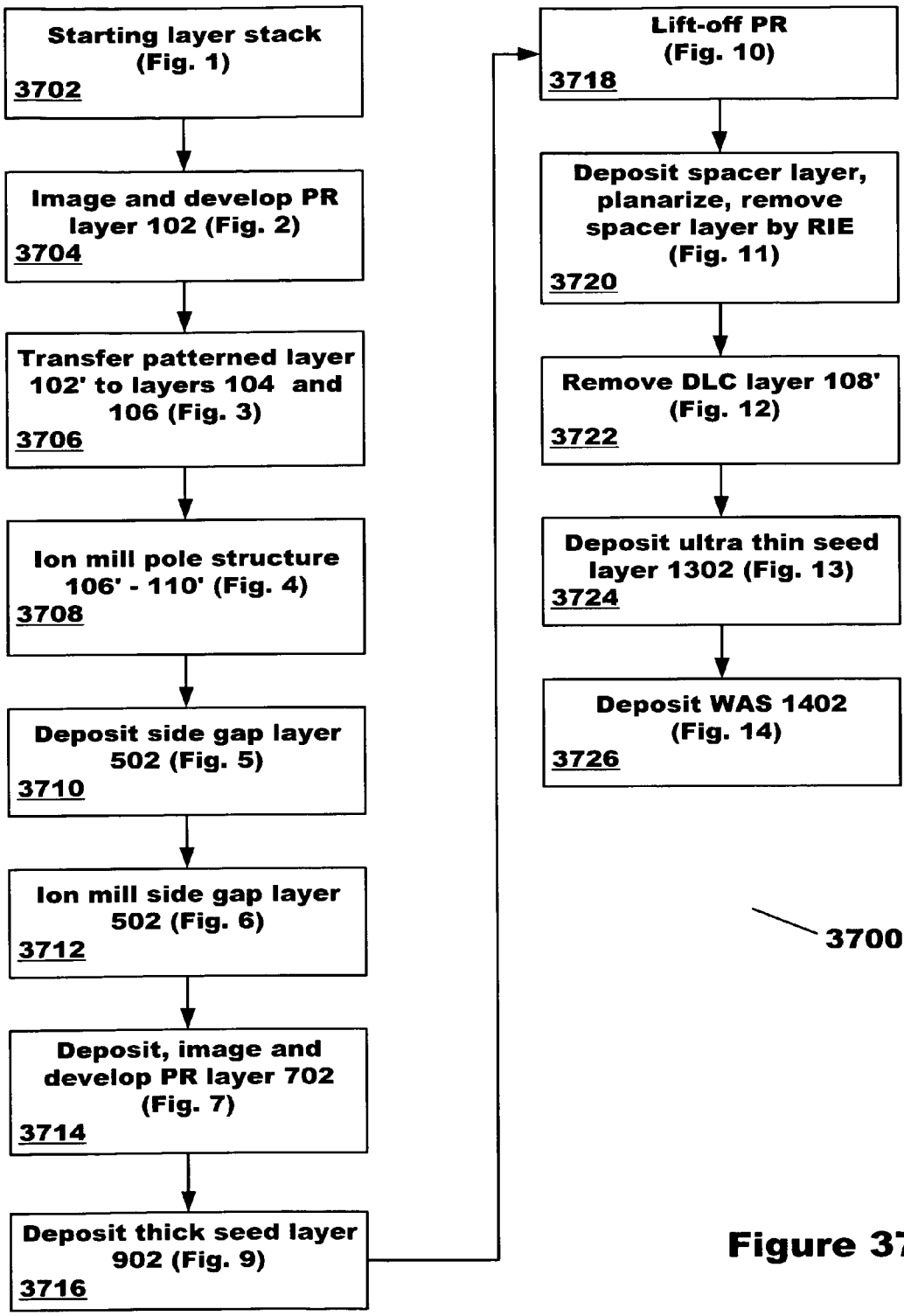
FIG. 37 is a block diagram of a first process to fabricate a wrap around shield, in accordance with an embodiment of the present invention.
Figure 38:
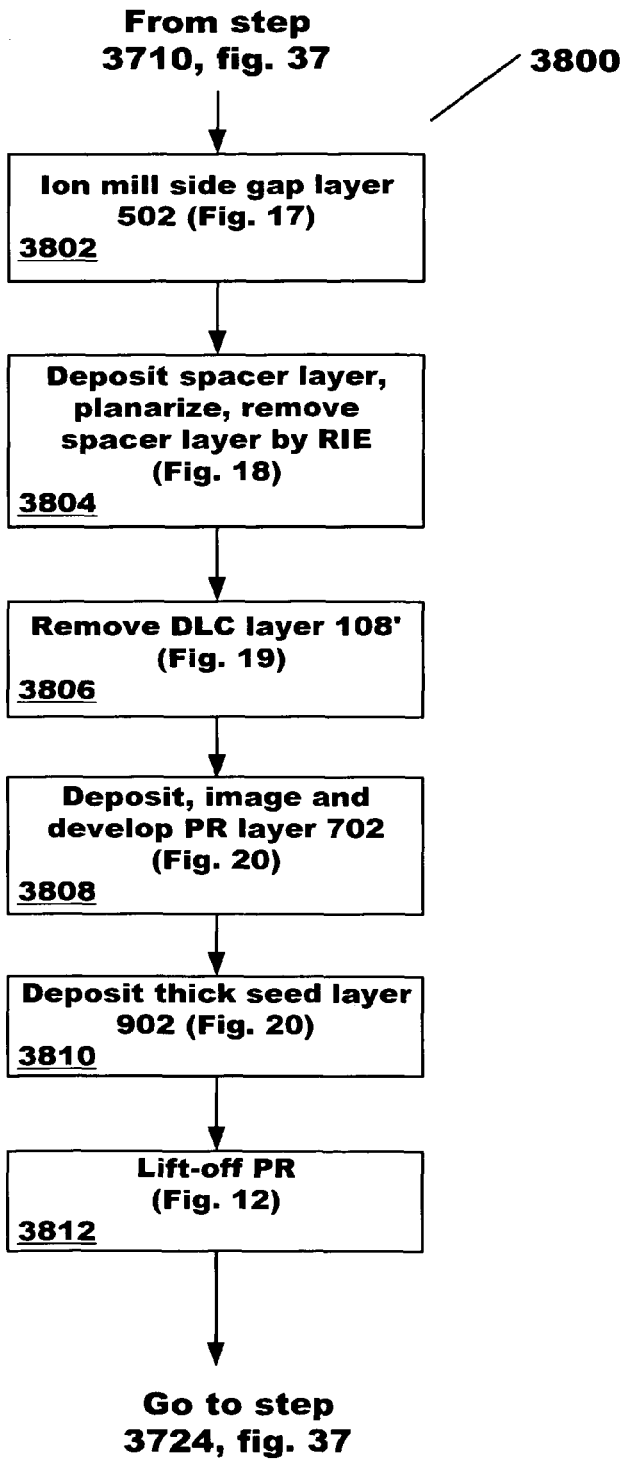
FIG. 38 is a block diagram of a second process to fabricate a wrap around shield, in accordance with an embodiment of the present invention.
Figure 39:
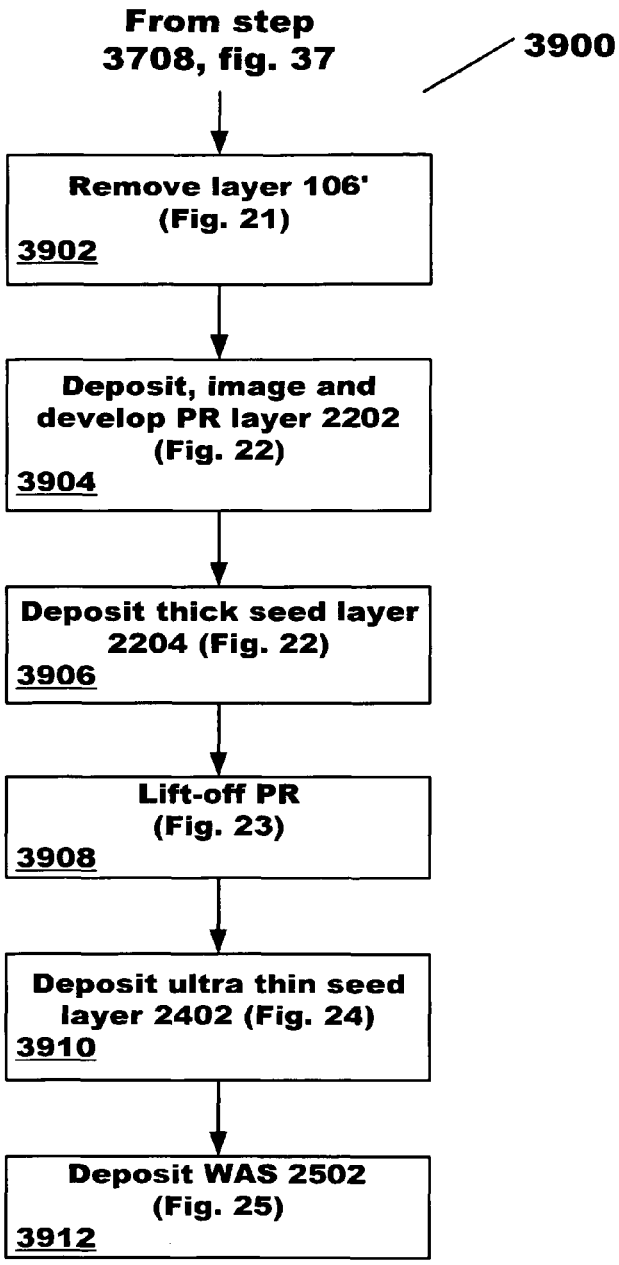
FIG. 39 is a block diagram of a third process to fabricate a wrap around shield, in accordance with an embodiment of the present invention.
Figure 40:
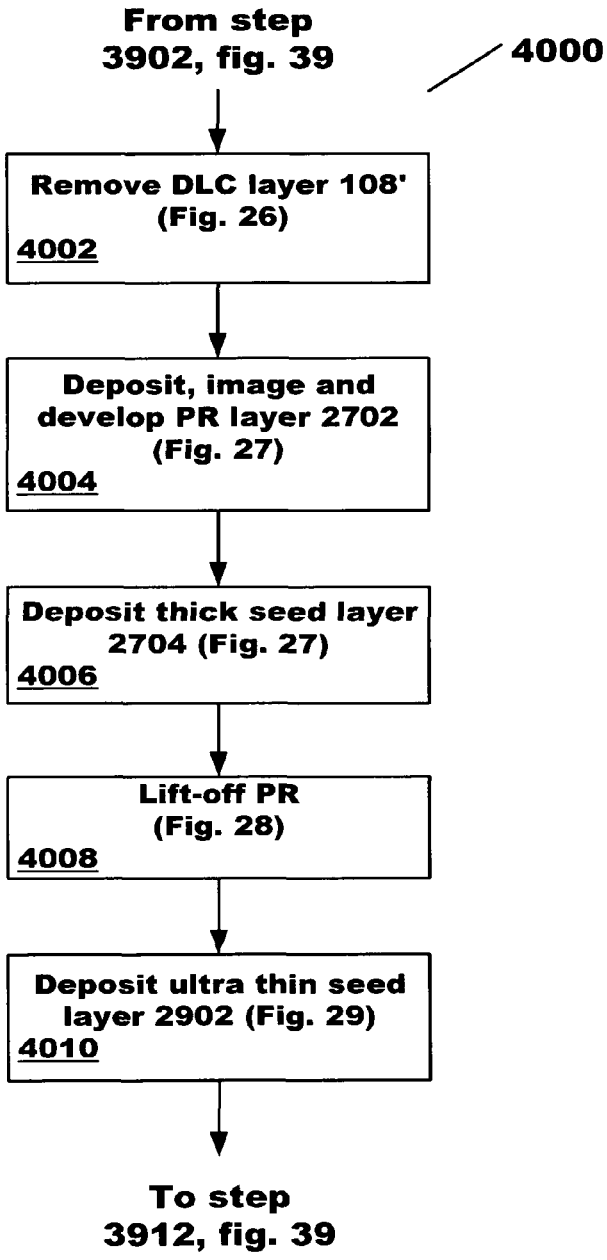
FIG. 40 is a block diagram of a fourth process to fabricate a wrap around shield, in accordance with an embodiment of the present invention; and, FIG. 41 is a block diagram of a process to fabricate a trailing shield, in accordance with an embodiment of the present invention.
Figure 41:
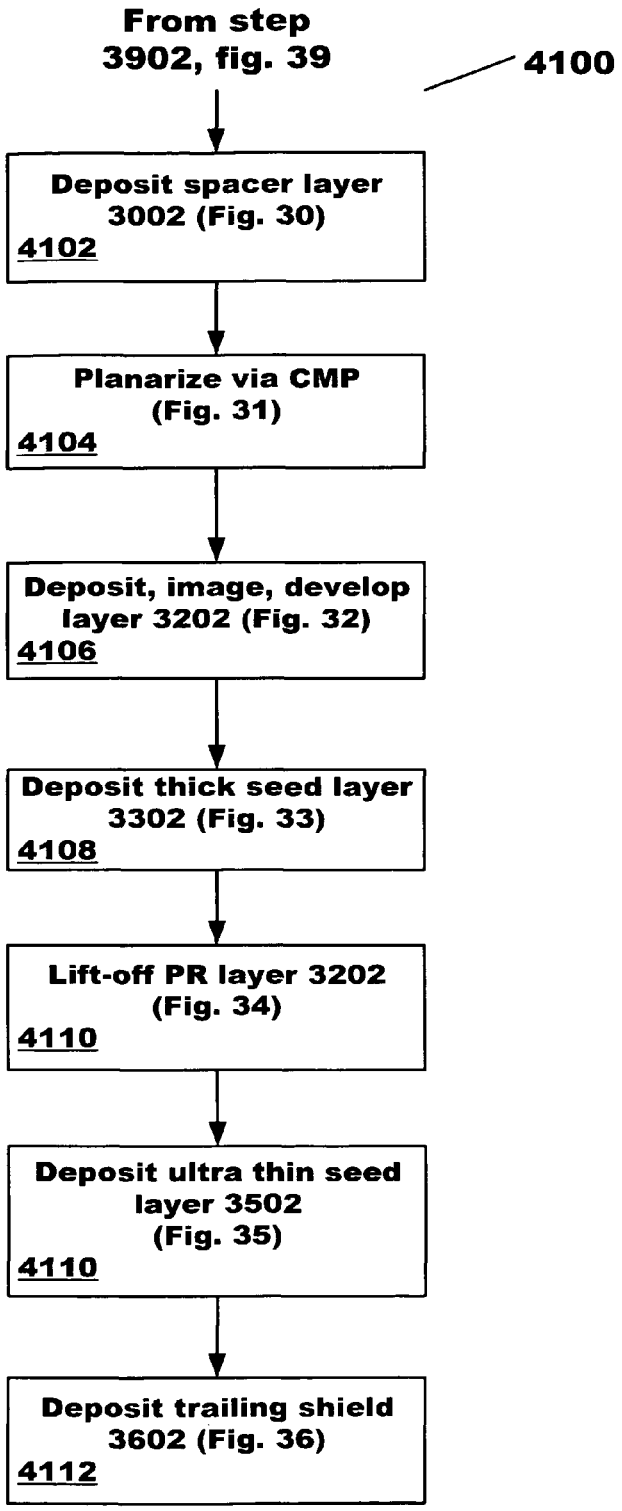

The features and description of embodiments the present invention are best understood while viewing the cross sectional structure views (FIGS. 1-36) in light of the process block diagrams (FIG. 37-41). FIGS. 37, 38 disclose first and second processes, respectively, for fabricating a wrap around shield having a side gap thickness greater than the top gap thickness, with the side gap thickness independently adjustable from that of the top gap. FIG. 38 discloses a process similar to that of FIG. 37, except for the re-arrangement of steps to reduce the potential for oxidation of the thick seed layer during the removal of the DLC layers. FIGS. 39 and 40 disclose third and fourth processes, respectively, for fabricating wrap around shields wherein side and top gaps have the same thickness. FIG. 40 discloses a process similar to that of FIG. 39, except for the re-arrangement of steps to reduce the potential for oxidation of the thick seed layer during the removal of the DLC layers. FIG. 41 discloses a fifth process for fabricating a trailing shield having an ultra-thin seed layer gap.

Figure 1:
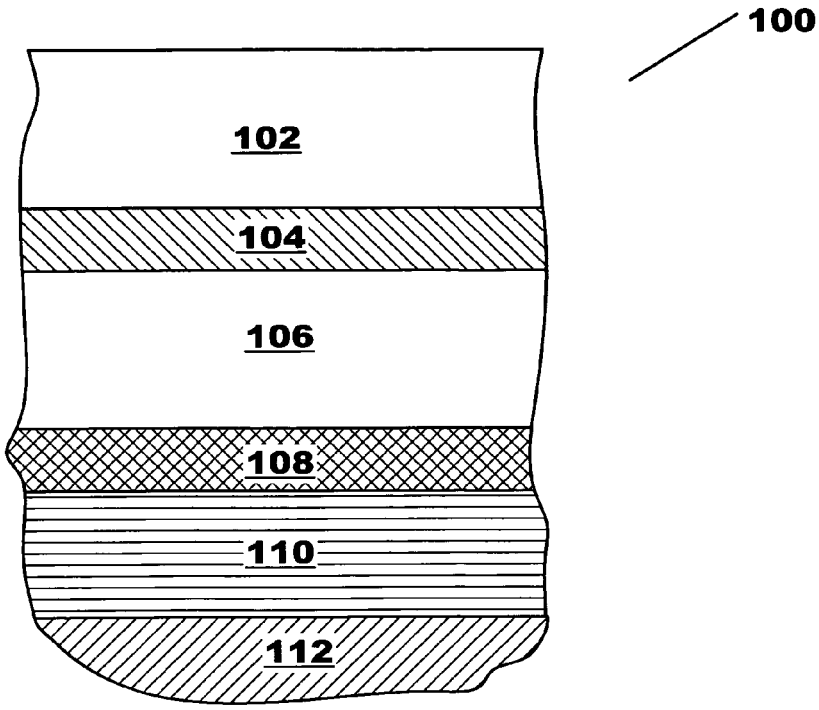
FIG. 1 is a partial cross section view of the starting film stack, in accordance with embodiments of the present invention.

FIG. 37 is a block diagram 3700 of a first process to fabricate a wrap around shield, in accordance with an embodiment of the present invention. The process begins in step 3702 with a starting thin film layers stack as shown in FIG. 1. FIG. 1 is a partial cross section view of the starting film stack, in accordance with embodiments of the present invention. Layers 102, 104, 106, 108, and 110 are deposited on base layer 112, which may be a substrate layer or any other layer compatible with subsequently deposited layers and the electronic function of the completed device. Layer 110 is comprised of magnetic alloys, such as CoFe, CoNiFe, suitable for use in the finished write pole. It may also contain laminates or layers of non-magnetic materials (not shown) as is well known to those skilled in the art. Layer 108 is comprised of DLC (diamond-like carbon), chosen for its suitability as a planarization stop layer. It must be removed completely prior to deposition of the ultra-thin non-magnetic gap layer. There may be cases where this layer can be omitted, where no planarization step is required in the process. These will be noted in discussion below. Layer 106 is comprised of Durimide. Layer 104 is comprised of silica. Layer 102 comprises photo resist and other image transfer components. Details of this layer 102, well known in the art, are not shown for simplicity.

Figure 2B:
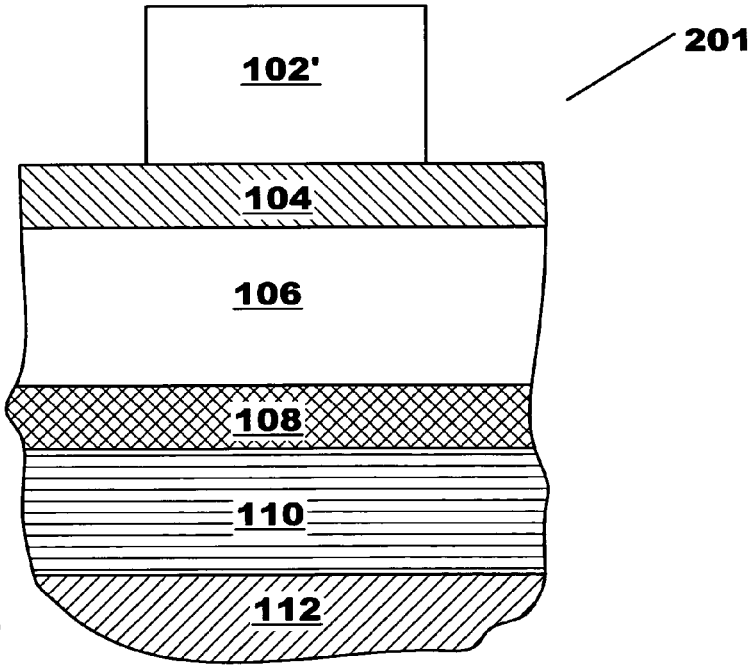
FIG. 2*b* is a partial cross section view through section A-A of FIG. 2*a*, in accordance with embodiments of the present invention.
Figure 2A:
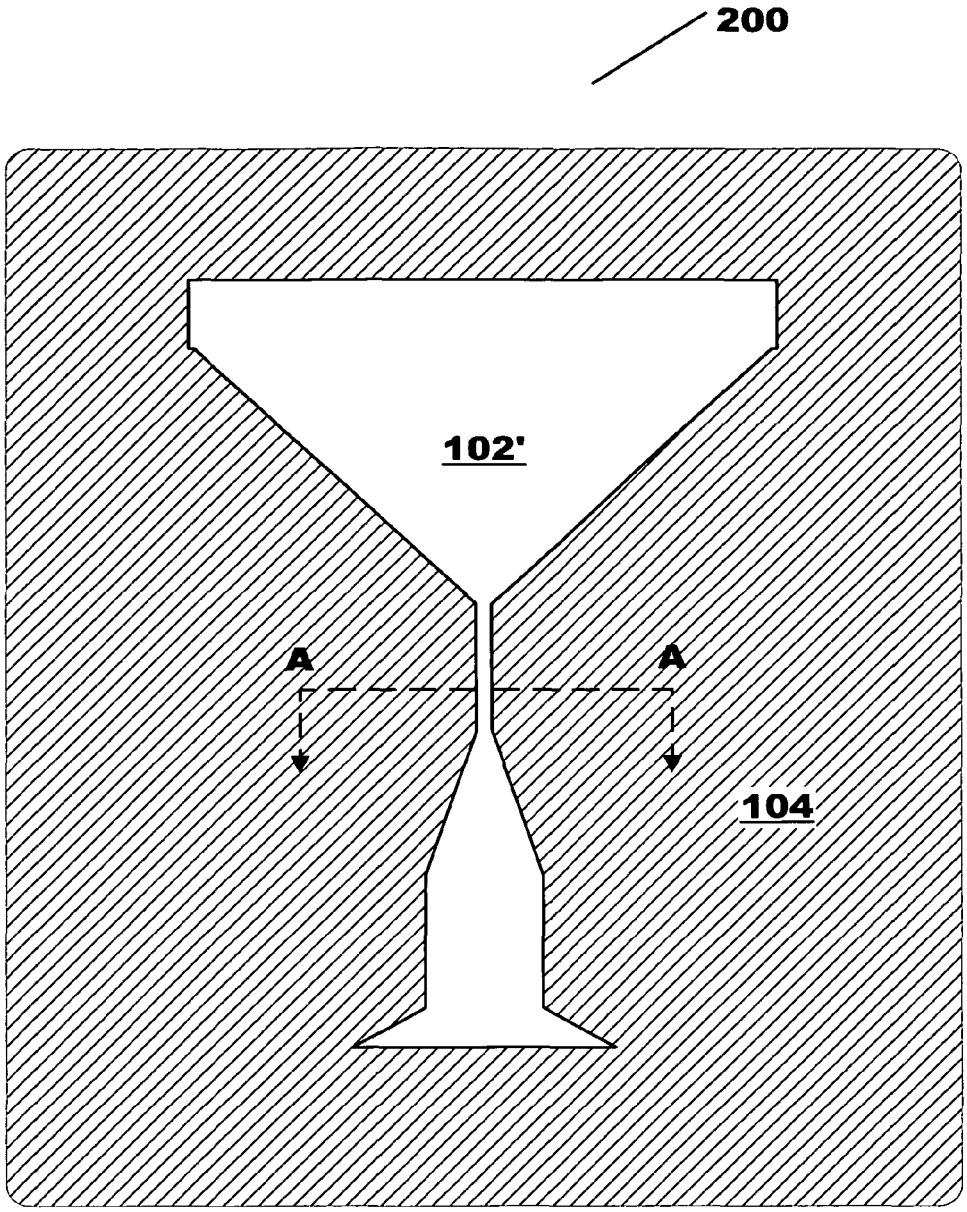
FIG. 2*a* is a partial plan view of the structure of FIG. 1 subsequent to the imaging and development of photo resist layer 102, in accordance with embodiments of the present invention.

Returning to FIG. 37, in step 3704, the photo resist layer 102 is imaged and developed. FIG. 2*a* is a partial plan view 200 of the structure of FIG. 1 subsequent to the imaging and development of photo resist layer 102, in accordance with embodiments of the present invention. FIG. 2*b* is a partial cross section view 201 through section A-A of FIG. 2*a*. After imaging and development, photo resist feature 102' defines the shape of the pole to be fabricated.

Figure 3:
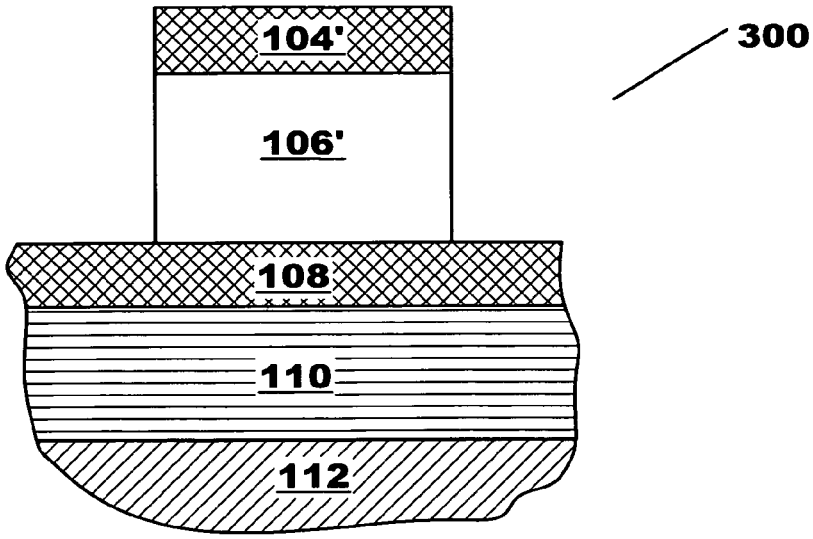
FIG. 3 is a partial cross section view of the structure of FIGS. 2*a,b* subsequent to the transfer of the image of layer 102' to layers 104 and 106, in accordance with embodiments of the present invention.

Returning to FIG. 37, in step 3706, feature 102' is transferred to silica layer 104' and Durimide layer 106'. Layer 102' is removed. This is accomplished by two different RIE processes. The first transfers the photo resist pattern into the silica layer 104; the second transfers the pattern into the underlying Durimide layer 106 (and DLC layer 108, not shown) using feature 104'. The specific etch process conditions are well known to those skilled in the art. FIG. 3 is a partial cross section view 300 of the structure of FIGS. 2*a,b* subsequent to the transfer of the image of layer 102' to layers 104 and 106, in accordance with embodiments of the present invention. Features 106' and 104' are formed.

Figure 4:
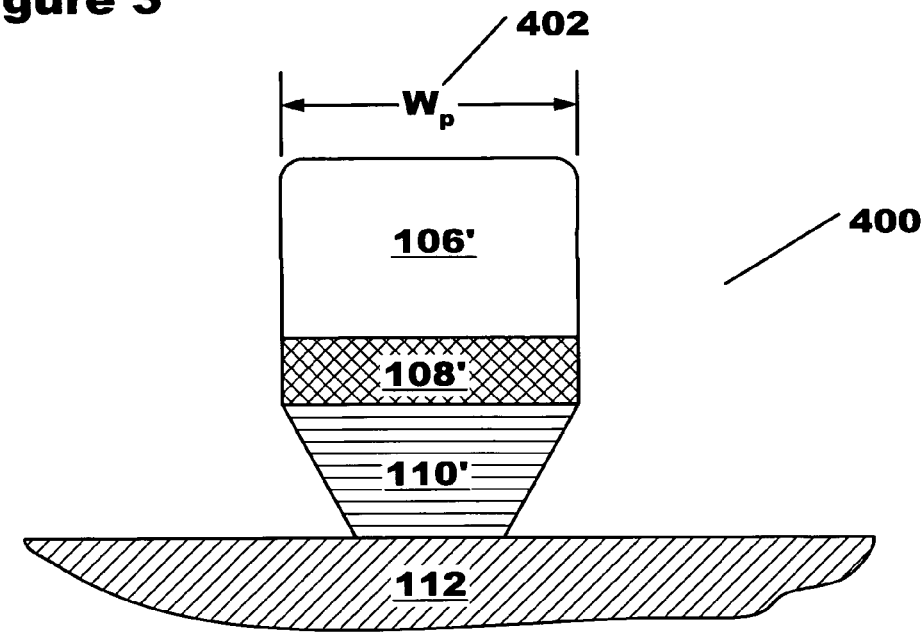
FIG. 4 is a partial cross section view subsequent to formation and shaping of pole layer 110', in accordance with embodiments of the present invention.

Returning to FIG. 37, in step 3708, the structure of FIG. 3 is ion milled to form and taper the pole layer 110'. FIG. 4 is a partial cross section view 400 subsequent to formation and shaping of pole layer 110', in accordance with embodiments of the present invention. The width of the pole is shown as $W_p$ ref 402.

Figure 5:
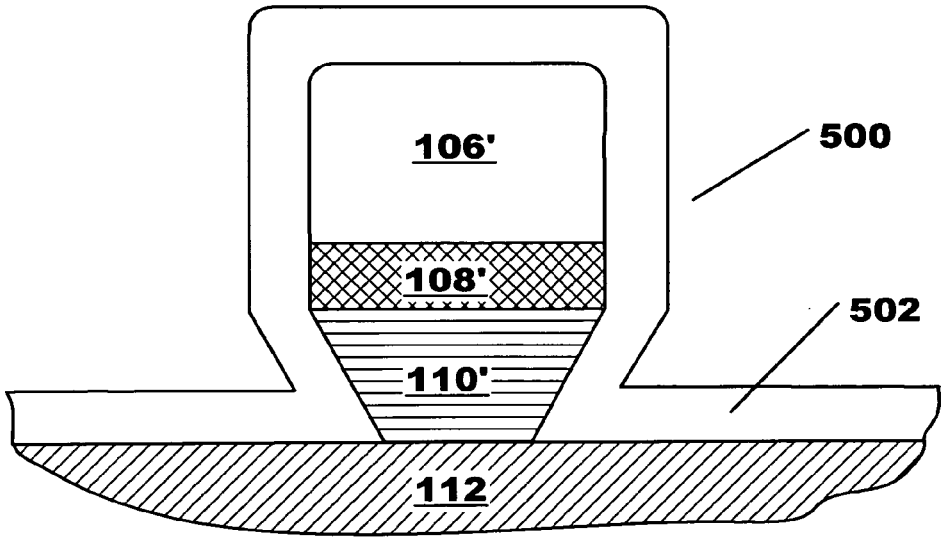
FIG. 5 is a partial cross section view of the structure of FIG. 4 subsequent to the deposition of side gap layer 502, in accordance with embodiments of the present invention.

Returning to FIG. 37, in step 3710, side gap layer 502 is deposited. Layer 502 is typically alumina, deposited by atomic layer deposition (ALD), as is known to those in the art. In this step, the thickness of the side gap can be partially determined. The total thickness will be equal to the final thickness of layer 502 plus any additional seed layer added to it (see below). FIG. 5 is a partial cross section view 500 of the structure of FIG. 4 subsequent to the deposition of side gap layer 502, in accordance with embodiments of the present invention.

Figure 6:
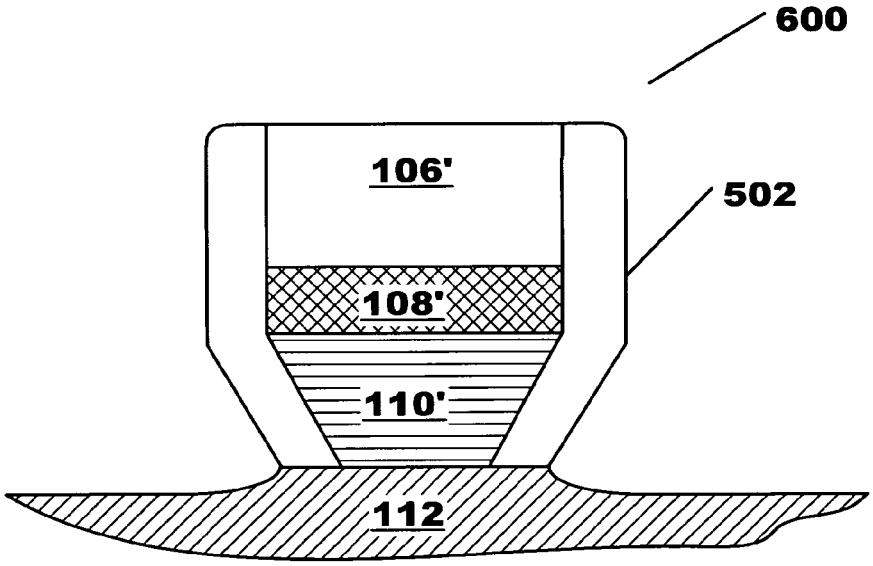
FIG. 6 is a partial cross section view of the structure of FIG. 5 subsequent to ion milling, in accordance with embodiments of the present invention.

Returning to FIG. 37, in step 3712, the structure of FIG. 5 is ion milled to finalize the side gap thickness and recess layer 112 below the pole layer 110'. FIG. 6 is a partial cross section view 600 of the structure of FIG. 5 subsequent to ion milling, in accordance with embodiments of the present invention. Conditions and processes for the ion milling are well known to those skilled in the art.

Returning to FIG. 37, in step 3714, a blanket photo resist layer is deposited, imaged, and developed, forming photo resist feature 702. FIG. 7 is a partial cross section view 700 of the structure of FIG. 6 subsequent to the formation of photo resist feature 702, in accordance with an embodiment of the present invention. Photo resist feature 702 is approximately centered over pole layer 110' and extends beyond the width of the pole $W_p$ (ref 402) by a dimension $T_w$ (ref 704) on both sides. Note that FIG. 7 is not to scale, and that $T_w$ (ref 704) will vary depending on a number of alternate embodiments of the present invention, discussed below in FIGS. 8*a-c*.

Figure 8A:
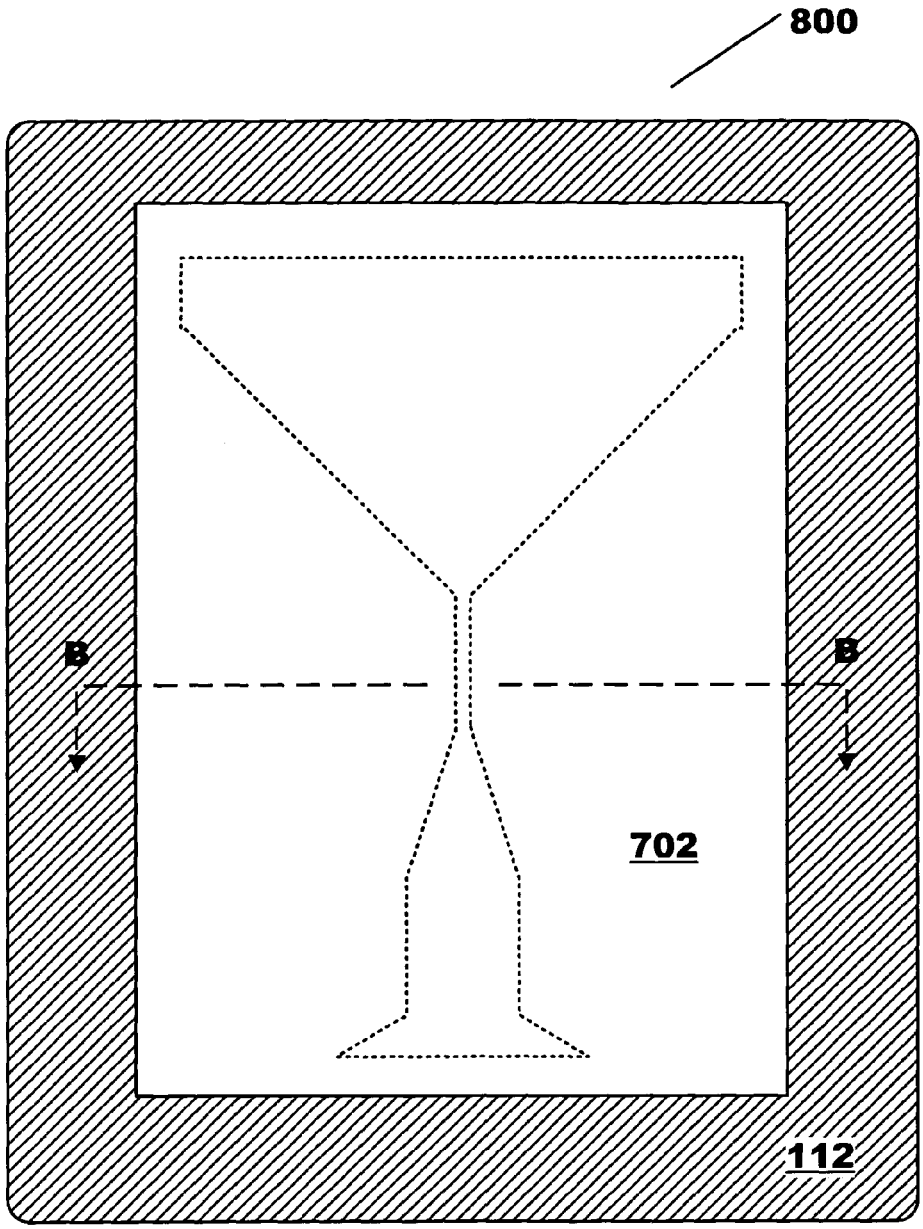
FIG. 8*a* is a partial plan view of the structure of FIG. 7, in accordance with an embodiment of the present invention.
Figure 8B:
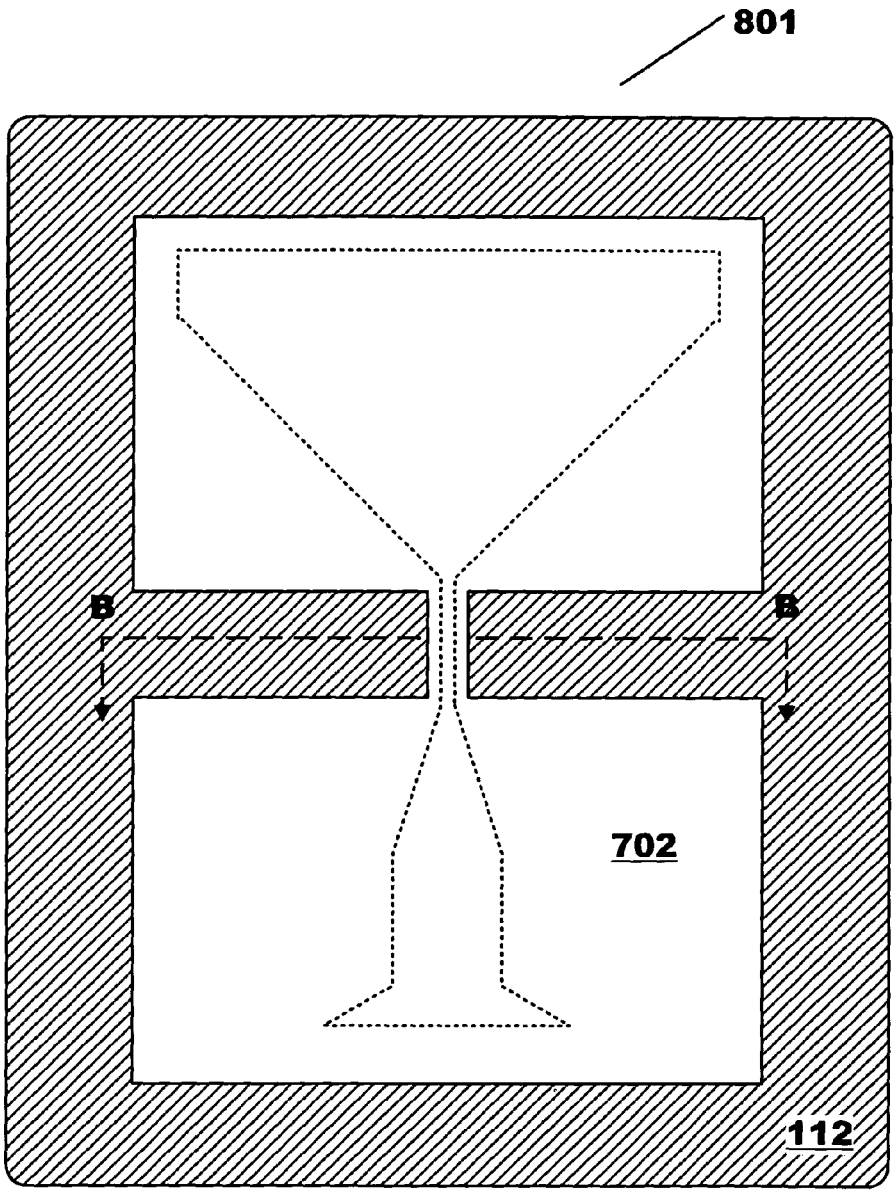
FIG. 8*b* is a partial plan view of the structure of FIG. 7, in accordance with an alternate embodiment of the present invention.
Figure 8C:
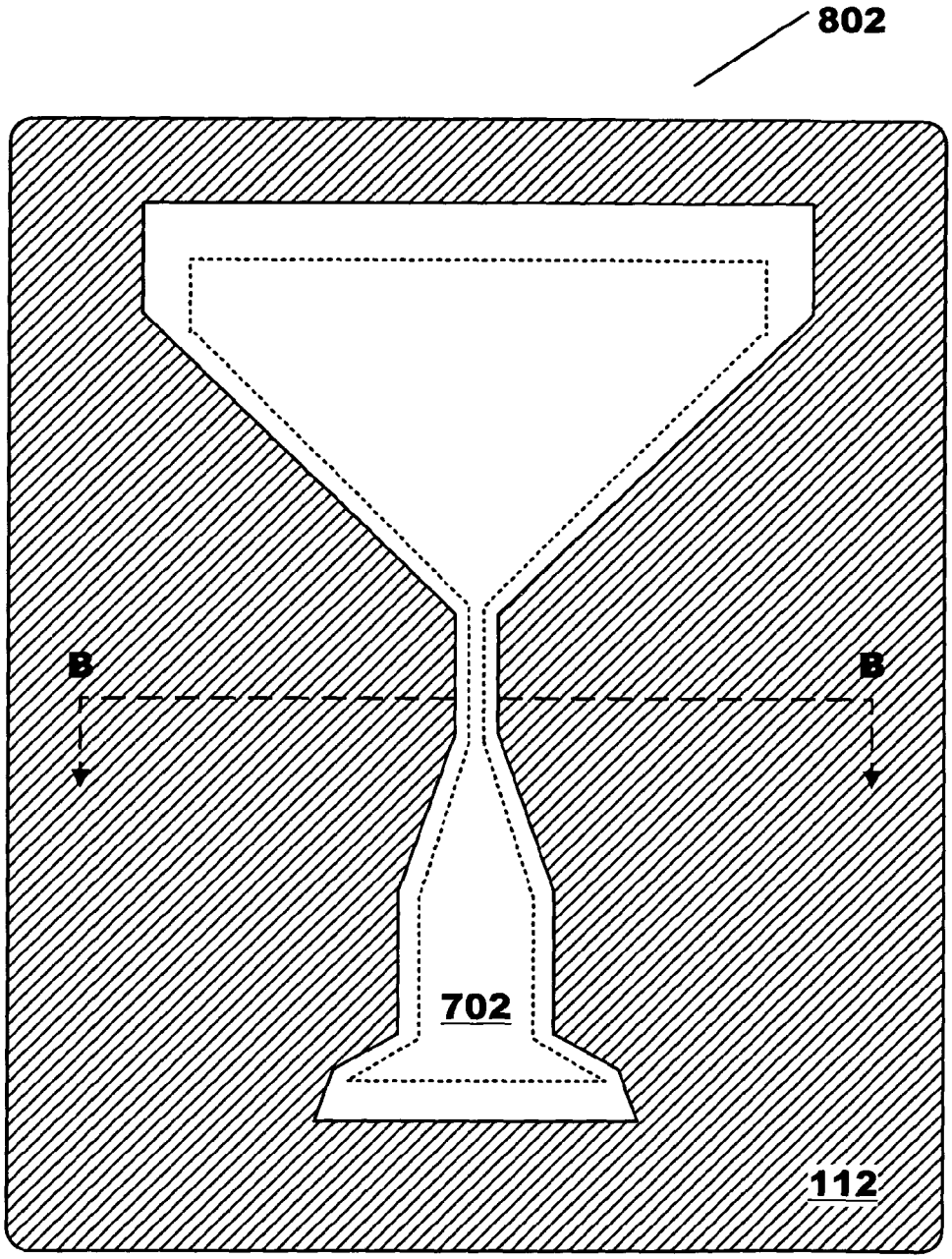
FIG. 8*c* is a partial plan view of the structure of FIG. 7, in accordance with an additional alternate embodiment of the present invention.

FIG. 8*a* is a partial plan view 800 of the structure of FIG. 7, in accordance with an embodiment of the present invention. FIG. 7 is a cross section through section B-B of FIG. 8*a*. In this case, photo resist feature 702 spans the entire width of the pole, including the rear pole area beyond the flare point. FIG. 8*b* is a partial plan view 801 of the structure of FIG. 7, in accordance with an alternate embodiment of the present invention. FIG. 7 again is the cross section through section B-B of FIG. 8*b*. Dimension $T_w$ (ref 704) is considerably smaller than it would be in FIG. 8*a*, the purpose of which will be clarified in discussion following. FIG. 8*c* is a partial plan view 802 of the structure of FIG. 7, in accordance with an additional alternate embodiment of the present invention. In this embodiment, photo resist feature 702 is approximately conformal to the outer perimeter of pole layer 110', having a dimension $T_w$ (ref 704) considerably smaller than that of FIG. 8*a*.

Returning to FIG. 37, in step 3716, a thick seed layer 902 is deposited as a blanket layer over the structure of FIG. 7. The purpose of the thick seed layer 902 is to provide a low resistance conduit for electroplating the wrap around shield structure. The thick seed layer 902 may extend to the outer perimeter of the substrate where the electrical plating contacts are made, or alternatively, the thick seed layer may be electrically coupled to an additional conductive bus system on the substrate that makes connection with the power system need to supply electroplating current. Typically, thick seed layer 902 is between about 100 nm and 500 nm thick, preferably between about 250 to 300 nm thick. Thick seed layer 902 can be comprised of any suitable electrical conductor, preferably a metal. Noble metals such at Pd, Au, Rh, Ru, and Pt are suitable, but less desirable due to cost considerations. Noble metals may be more desirable than, for example base metals such as copper or Fe—Co—Ni alloys due to their oxidation resistance. Oxidation resistance may be desirable to minimize damage to the thick seed layer 902 during a subsequent DLC removal step, discussed below. Fe—N—Co alloys may be desirable due to their low cost, good adhesion to photo resist layers, and compatibility with shield electroplating solutions, oxidation resistance not withstanding. FIG. 9 is a partial cross section view 900 of the structure of FIG. 7 subsequent to the blanket deposition of thick seed layer 902, in accordance with an embodiment of the present invention.

Figure 10:
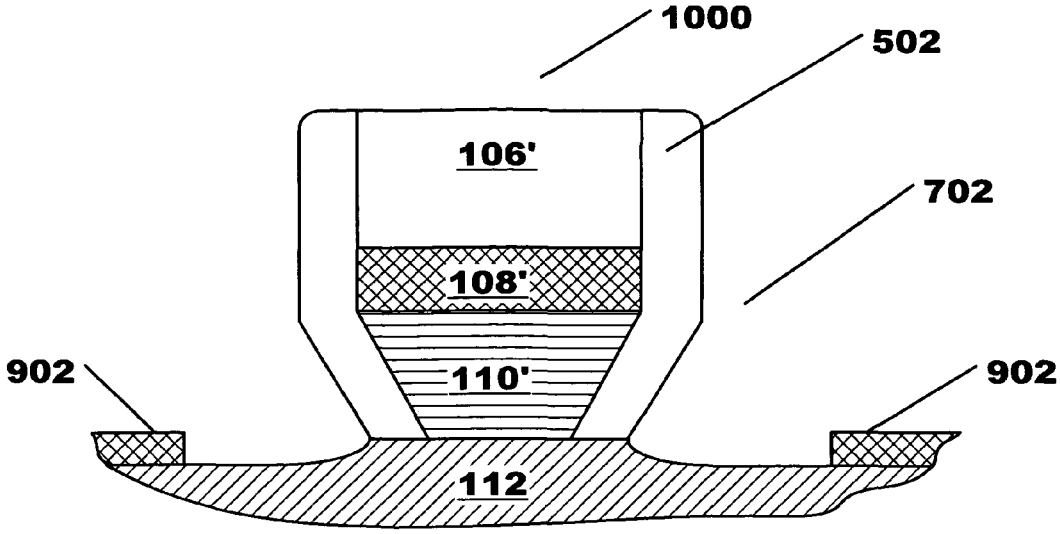
FIG. 10 is a partial cross section view of the structure of FIG. 9 subsequent to the lift of photo resist feature 702, in accordance with an embodiment of the present invention.

Returning to FIG. 37, in step 3718, photo resist feature 702 and a portion of thick seed layer 902 is removed in a photo resist lift-off step. The processes and conditions associated with photo resist lift off are well known to those skilled in the art. Subsequent to lift off, the portion of thick seed layer 902 originally deposited on base layer 112 remains, whereas portions of seed layer 902 originally deposited on photo-resist feature 702 are removed with the photo resist. This produces a thick seed layer pattern that is a negative image of the developed photo resist feature 702 disclosed in FIGS. 8*a*-8*c*. FIG. 10 is a partial cross section view 1000 of the structure of FIG. 9 subsequent to the lift of photo resist feature 702, in accordance with an embodiment of the present invention.

Figure 11:
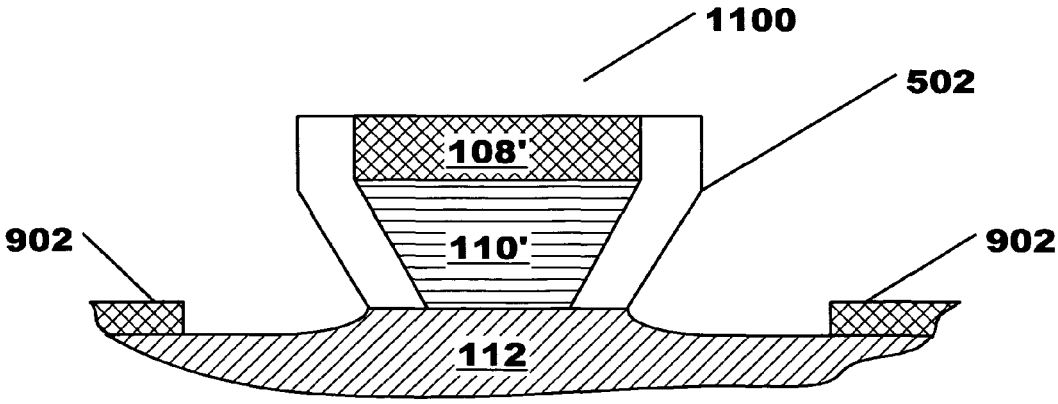
FIG. 11 is a partial cross section view of the structure of FIG. 10 subsequent to the deposition of a filler layer, planarization, and removal of the filler layer, in accordance with an embodiment of the present invention.

Returning to FIG. 37, in step 3720, an etchable spacer layer is blanket deposited over the structure of FIG. 10 (not shown). The resulting structure is then planarized by CMP down to DLC layer 108', removing a portion of the spacer layer and Durimide feature 106' (not shown). The spacer layer is then removed by RIE (not shown). Details of the preceding processes of step 3720 are well known to those in the art. FIG. 11 is a partial cross section view 1100 of the structure of FIG. 10 subsequent to the foregoing processes, in accordance with an embodiment of the present invention.

Figure 12:
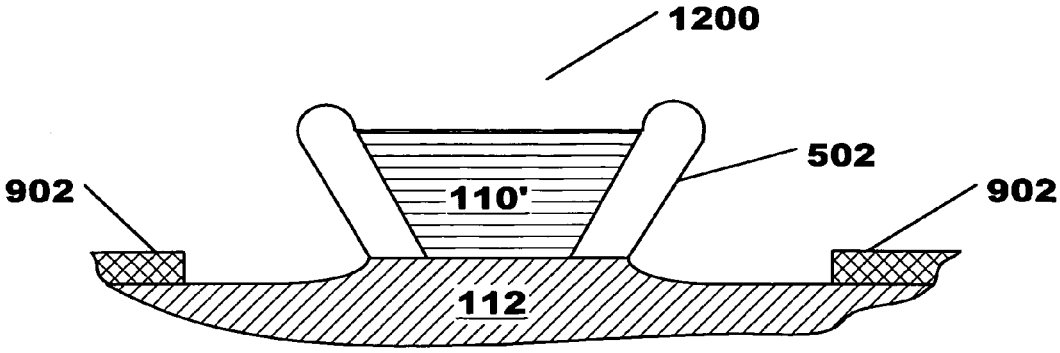
FIG. 12 is a partial cross section view of the structure of FIG. 11 subsequent to the removal of DLC layer 108', in accordance with an embodiment of the present invention.
Figure 13:
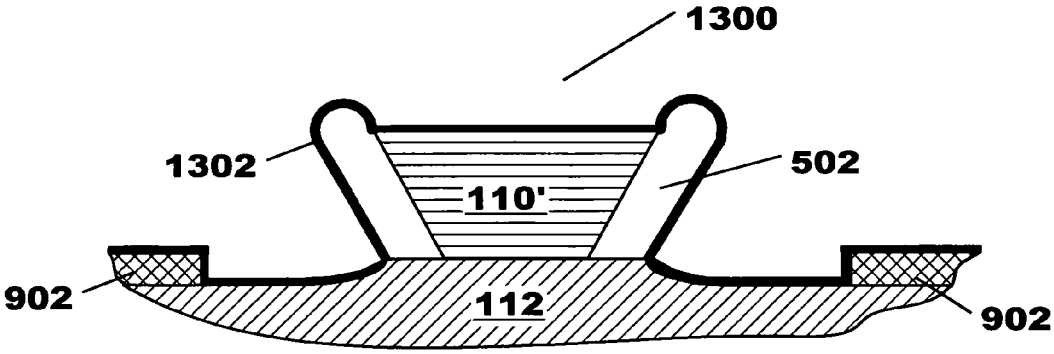
FIG. 13 is a partial cross section view of the structure of FIG. 12 subsequent to the deposition of ultra-thin seed layer 1302, in accordance with an embodiment of the present invention.

Returning to FIG. 37, in step 3722, DLC layer 108' is removed by oxidation. FIG. 12 is a partial cross section view 1200 of the structure of FIG. 11 subsequent to the removal of DLC layer 108', in accordance with an embodiment of the present invention. In step 3724 of FIG. 37, an ultra thin seed layer 1302 is blanket deposited on the structure of FIG. 12. This layer serves multiple purposes. First, it serves as a non-magnetic, ultra thin top gap layer between the top of pole layer 110' and the wrap around shield structure (to be deposited). Secondly, it serves as an electrical conduit to complete the electroplating of the wrap around shield structure conformal to the shape of the pole layer 110' and side gaps 502. The combination of thick seed layer 902, terminated in close proximity to the pole, and ultra thin seed layer 1302, assure proper plating coverage of the wrap around shield. Ultra thin seed layer 1302 is comprised of a non-magnetic metal, preferably a noble metal such Pd, Pt, Rh, and Ru. Typically, the thickness of ultra-thin seed layer 1302 is 2 to 3 nanometers, but thickness below 1 nanometer is possible (and may be required) for future applications. Without thick seed layer 902, it would not be possible to electroplate a wrap around shield on a blanket seed layer of 1 nanometer in thickness. For ultra thin seed layers 1302 on the order of 1 nanometer, it may be desirable to terminate the thick seed layer 902 as close as possible to the critical areas of the pole. Thus, the embodiments depicted in FIGS. 8*b* and 8*c* may be more suitable than that of FIG. 8*a*. In accordance with embodiments of the present invention, dimension $T_w$ is less than about 15 microns, preferably less that 10 microns. FIG. 13 is a partial cross section view 1300 of the structure of FIG. 12 subsequent to the deposition of ultra-thin seed layer 1302, in accordance with an embodiment of the present invention.

Figure 14:
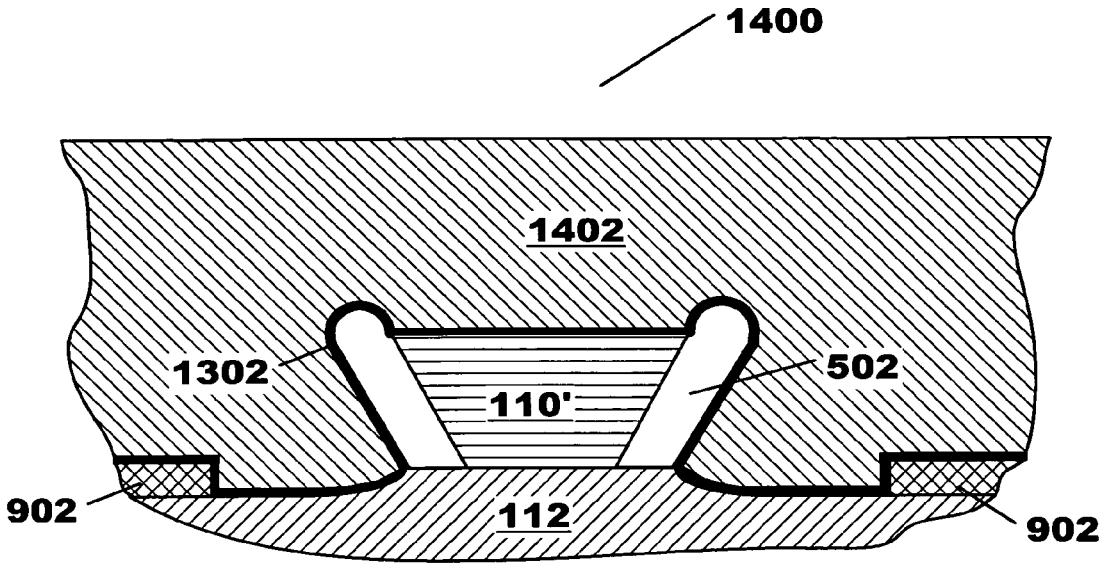
FIG. 14 is a partial cross section view of the structure of FIG. 13 subsequent to the electroplating of wrap around shield 1402, in accordance with an embodiment of the present invention.

Returning to FIG. 37, in step 3726, the wrap around shield is plated. FIG. 14 is a partial cross section view 1400 of the structure of FIG. 13 subsequent to the electroplating of wrap around shield 1402, in accordance with an embodiment of the present invention.

Figure 15:
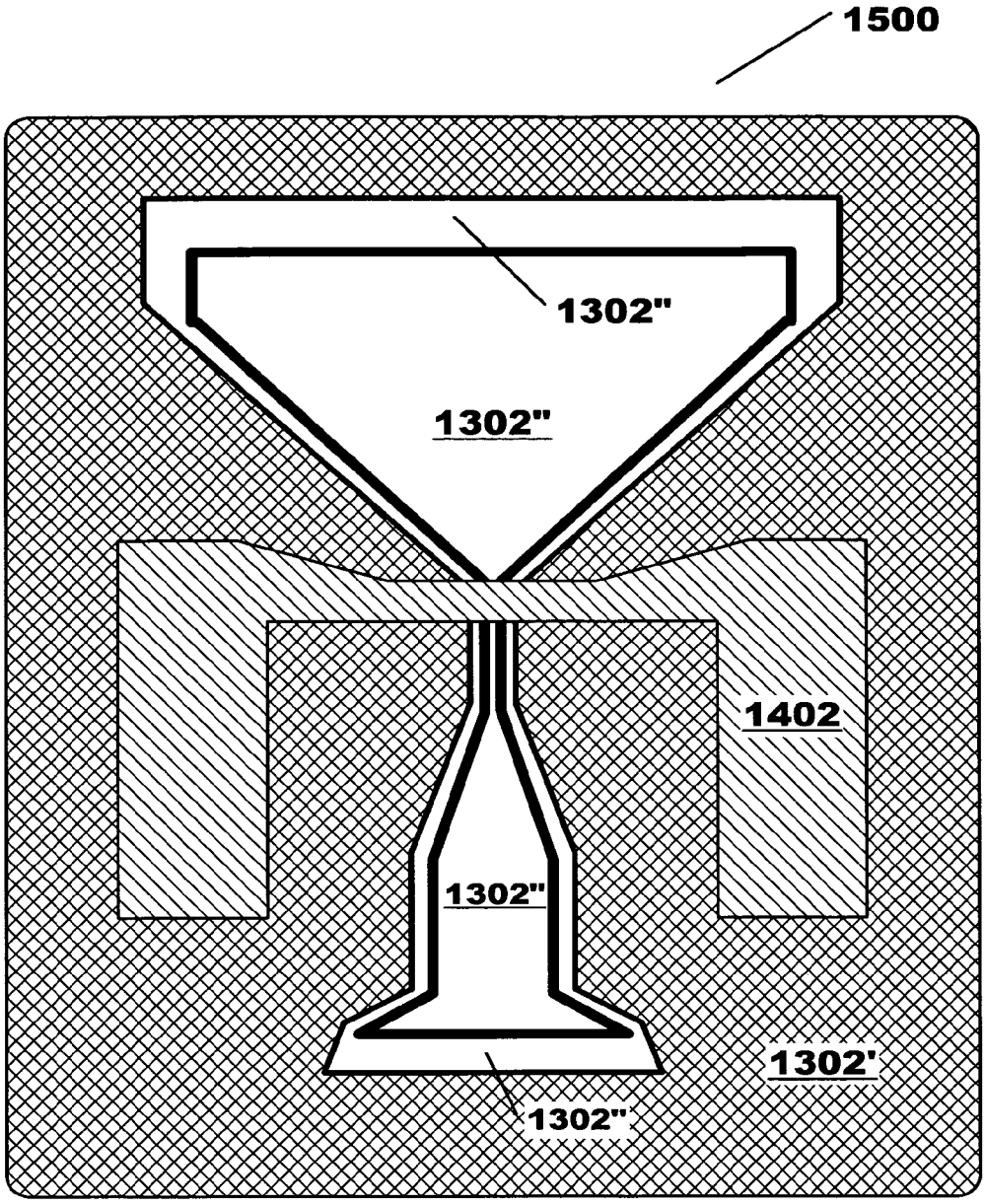
FIG. 15 is a partial plan view of the structure of FIG. 14, in accordance with the embodiment of the present invention shown in FIG. 8*c;*
Figure 16:
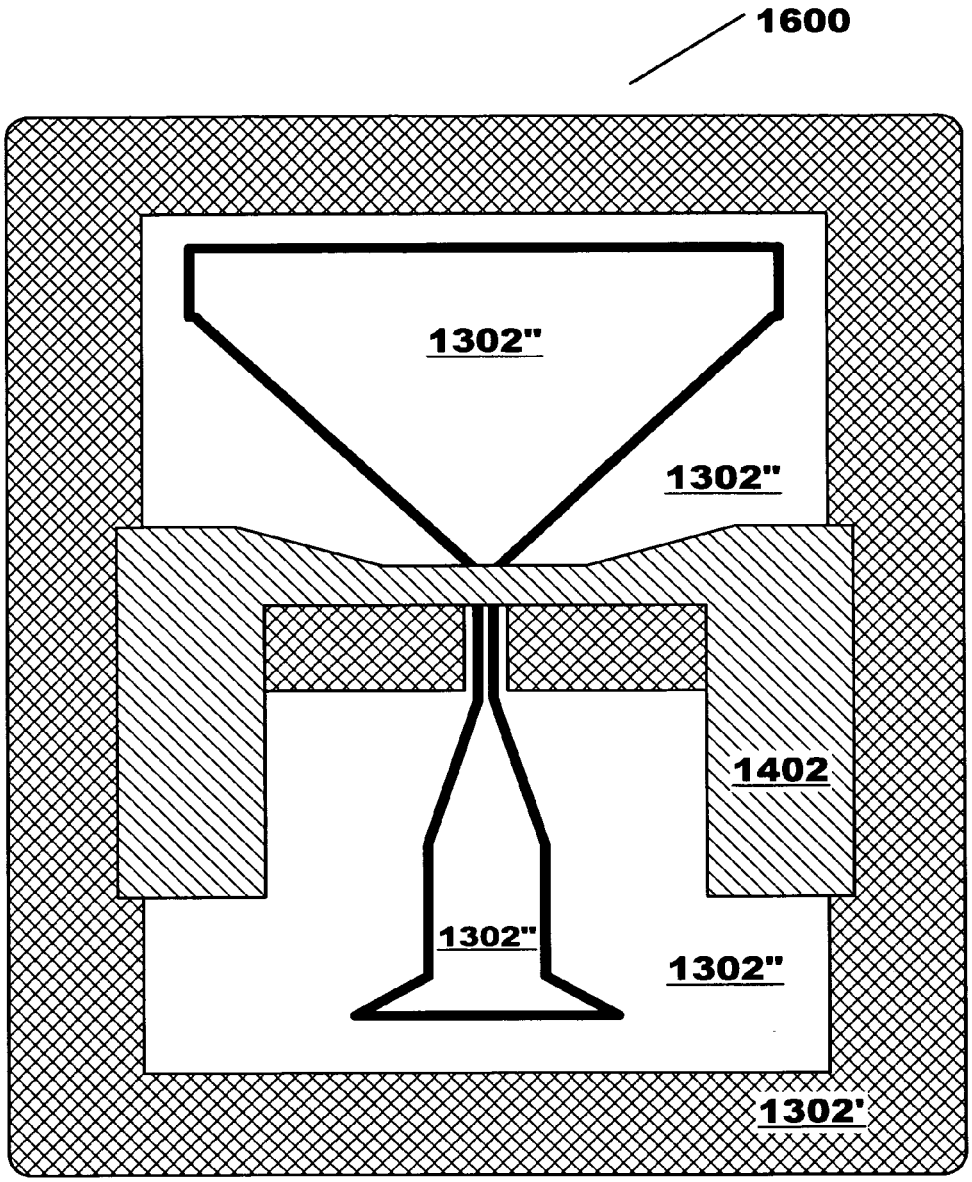
FIG. 16 is a partial plan view of the structure of FIG. 14, in accordance with the embodiment of the present invention shown in FIG. 8*b;*

FIG. 15 is a partial plan view 1500 of the structure of FIG. 14, in accordance with the embodiment of the present invention shown in FIG. 8*c*. Region 1302' represents the area covered by ultra thin seed layer 1302 over thick seed layer 902. Region 1302" represents the area covered by ultra thin seed layer 1302 over the pole layer 110', side gap 502, and a portion of base layer 112 adjacent to the pole. FIG. 16 is a partial plan view 1600 of the structure of FIG. 14, in accordance with the embodiment of the present invention shown in FIG. 8*b*.

Figure 17:
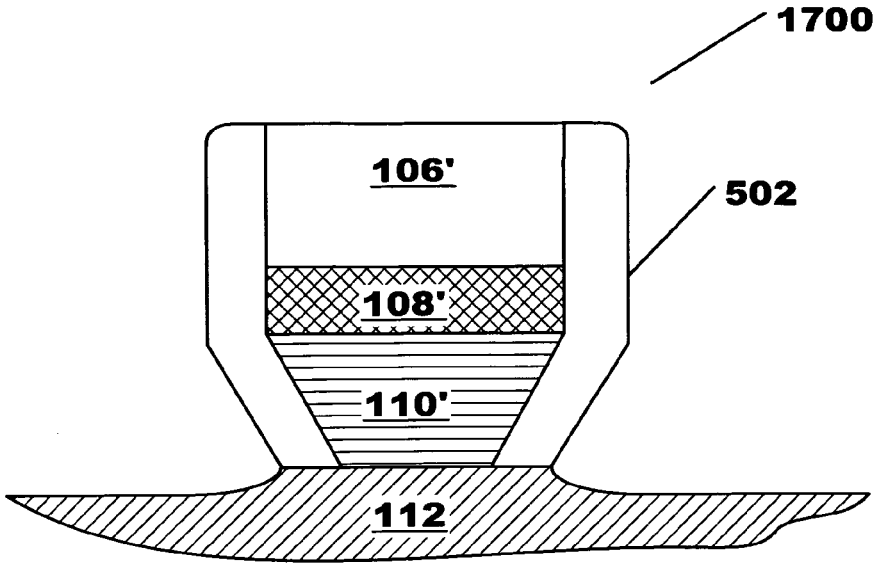
FIG. 17 is a partial cross section view of the structure of FIG. 5 subsequent to ion milling, in accordance with an embodiment of the present invention.
Figure 18:
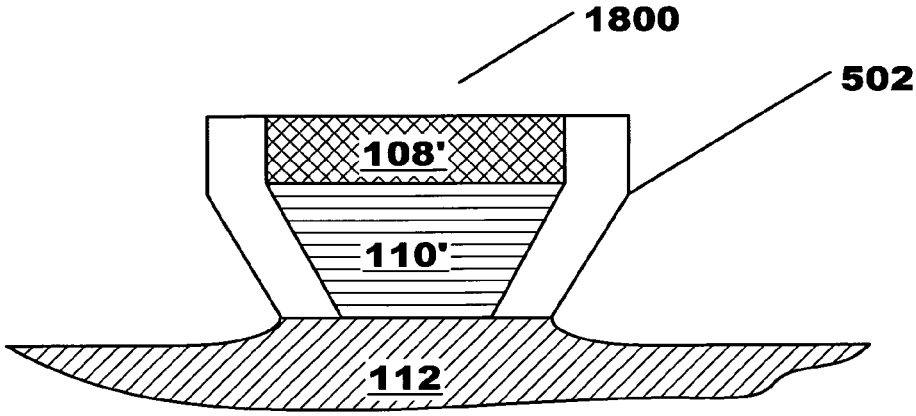
FIG. 18 is a partial cross section view of the structure of FIG. 17 subsequent to the deposition of a filler layer, planarization, and removal of the filler layer, in accordance with an embodiment of the present invention.

FIG. 38 is a block diagram 3800 of a second process to fabricate a wrap around shield, in accordance with an embodiment of the present invention. This embodiment differs from that of FIG. 37 in that the DLC layer 108' is removed before the deposition of the thick seed layer. Since the DLC layer must be removed by an oxidation process, the present embodiment avoids the potential oxidation of the thick seed layer during DLC removal. This is particularly important if the thick seed layer is comprised of base metals like copper, or magnetic alloys such as Fe—Co—Ni. This process shares a number of steps common to that of the first process of FIG. 37, namely steps 3702-3710, and 3724-3726. Detailed discussion of these steps shall not be repeated, as they are covered in detail above. The process begins as in step 3720 of FIG. 37, and proceeds through step 3710 as discussed above. In step 3802 of FIG. 38, side gap 502 and base layer 112 are ion milled in accordance with processes well known in the art. FIG. 17 is a partial cross section view 1700 of the structure of FIG. 5 subsequent to ion milling, in accordance with an embodiment of the present invention. In step 3804 of FIG. 38, an etchable spacer layer is blanket deposited over the structure of FIG. 17 (not shown). The resulting structure is then planarized by CMP down to DLC layer 108', removing a portion of the spacer layer and Durimide feature 106' (not shown). The spacer layer is then removed by RIE (not shown). Details of the preceding processes of step 3804 are well known to those in the art. FIG. 18 is a partial cross section view 1800 of the structure of FIG. 17 subsequent to the deposition of a filler layer, planarization, and removal of the filler layer, in accordance with an embodiment of the present invention.

Figure 19:
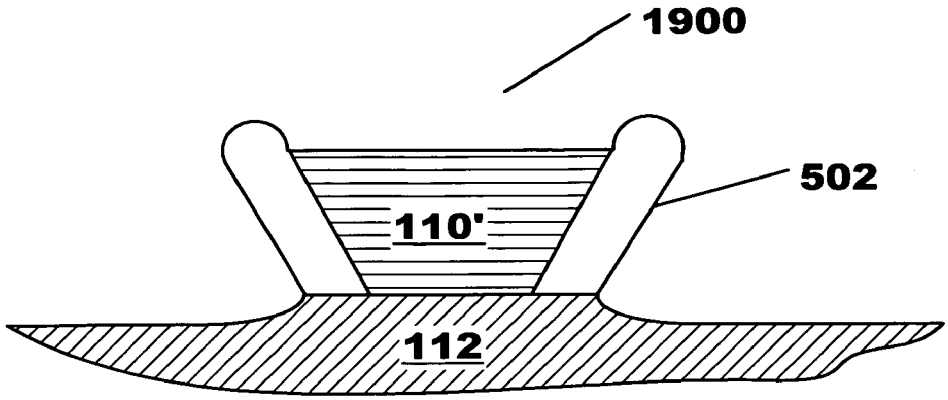
FIG. 19 is a partial cross section view of the structure of FIG. 18 subsequent to removal of DLC layer 108', in accordance with an embodiment of the present invention.
Figure 20:
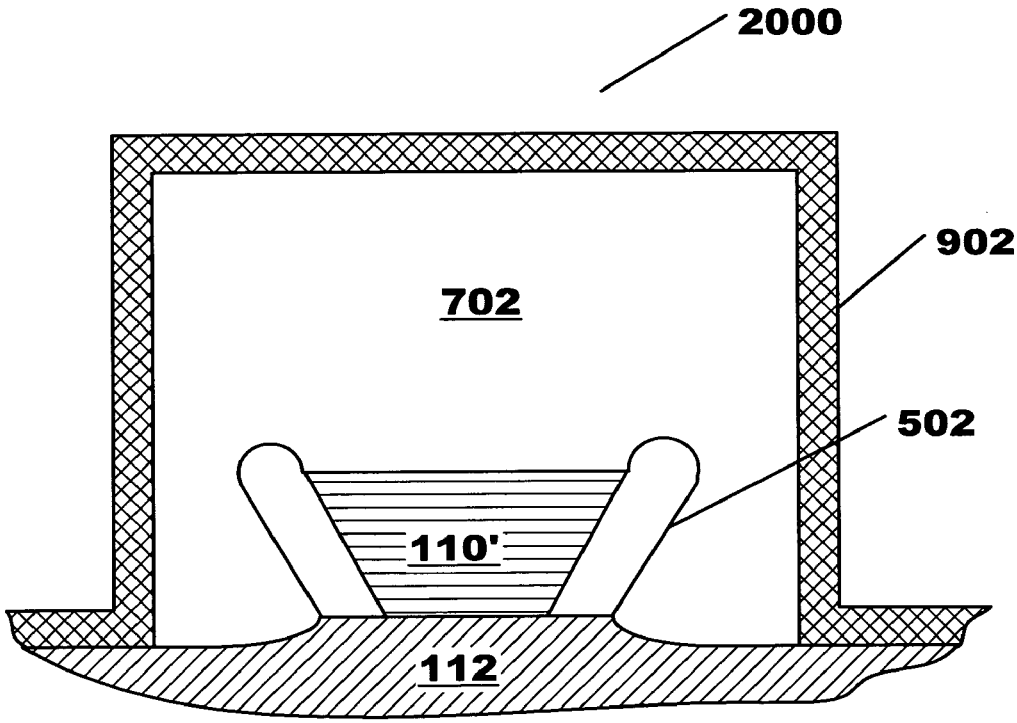
FIG. 20 is a partial cross section view of the structure of FIG. 19 subsequent to formation of photo resist feature 702 and deposition of thick seed layer 902, in accordance with an embodiment of the present invention.

Returning to FIG. 38, in step 3806 DLC layer 108' is removed by oxidation. FIG. 19 is a partial cross section view 1900 of the structure of FIG. 18 subsequent to removal of DLC layer 108', in accordance with an embodiment of the present invention. In step 3808 of FIG. 38, photo resist feature 702 is produced by deposition, imaging, and development of a blanket photo resist layer. Patterns in accordance with FIG. 8*a*, 8*b*, or 8*c* can be utilized as previously disclosed. In step 3810, a blanket thick seed layer 902 is deposited. Limitations and compositions of thick seed layer 902 have been previously discussed. FIG. 20 is a partial cross section view 2000 of the structure of FIG. 19 subsequent to formation of photo resist feature 702 and deposition of thick seed layer 902, in accordance with an embodiment of the present invention.

Returning to FIG. 38, in step 3812, photo resist feature 702 and a portion of thick seed layer 902 is removed in a lift off process. Subsequent to lift off, the structure of FIG. 20 becomes that shown in FIG. 12. Remaining process steps including the deposition of the ultra thin seed layer and plating of the wrap around shield are the same as steps 3724 and 3726 of FIG. 37.

Figure 21:
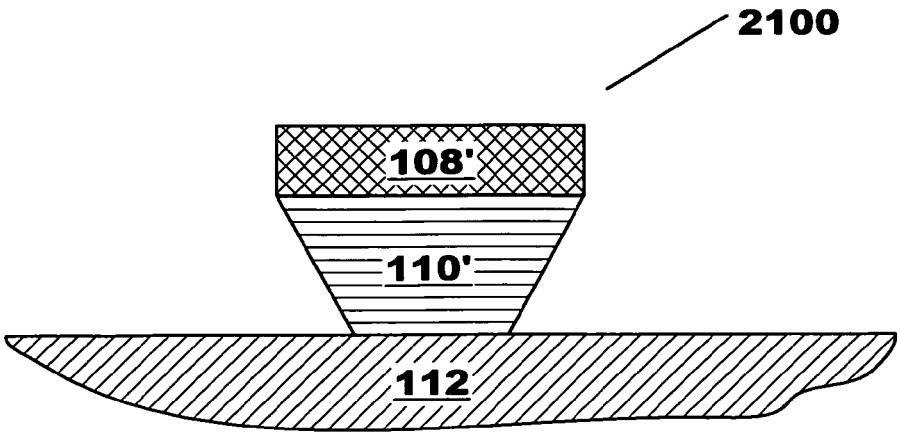
FIG. 21 is a partial cross section view of the structure of FIG. 4 subsequent to the removal of layer 106', in accordance with an embodiment of the present invention.

FIG. 39 is a block diagram 3900 of a third process to fabricate a wrap around shield, in accordance with an embodiment of the present invention. In this process, the side gap is replaced with ultra thin seed layer, producing a structure having both an ultra thin side gap and top gap. The process shares an number of steps with the first process of FIG. 37, namely steps 3702-3708. The process begins at step 3702 of FIG. 37, and proceeds through step 3708, as previously disclosed. In step 3902 of FIG. 39, Durimide layer 106' is removed in accordance with processes well known in the art. These processes generally involve a wet chemical soak to remove layer 106'. It should be noted that in this particular process, the DLC layer 108 is not required, since there is no planarization step needed to remove layer 106'. Alternatively, layer 106' could be removed as was done in the processes disclosed in the planarization processes of FIGS. 37 and 38, but this is not preferred due to added complexity and cost. The DLC layer 106 may be present in the initial layer stack of FIG. 1, even though it may not be needed in this particular embodiment, to maintain process consistency with other process options. FIG. 21 is a partial cross section view 2100 of the structure of FIG. 4 subsequent to the removal of layer 106', in accordance with an embodiment of the present invention.

Figure 22:
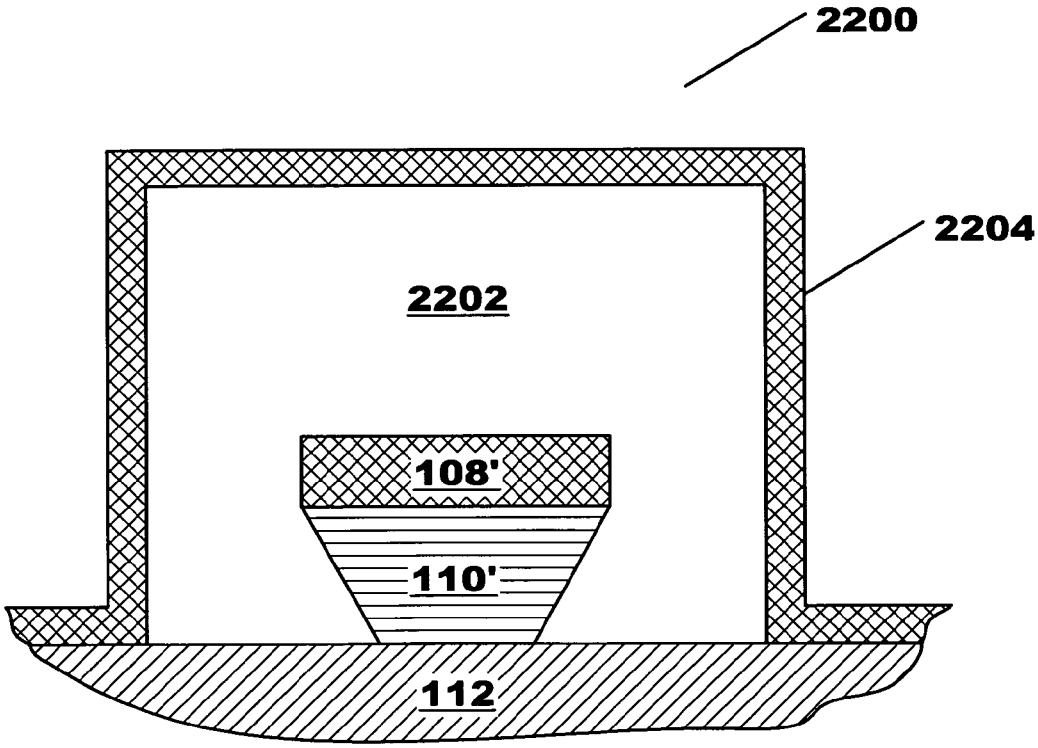
FIG. 22 is a partial cross section view of the structure of FIG. 21 subsequent to formation of photo resist feature 2202 and deposition of thick seed layer 2204, in accordance with an embodiment of the present invention.
Figure 23:
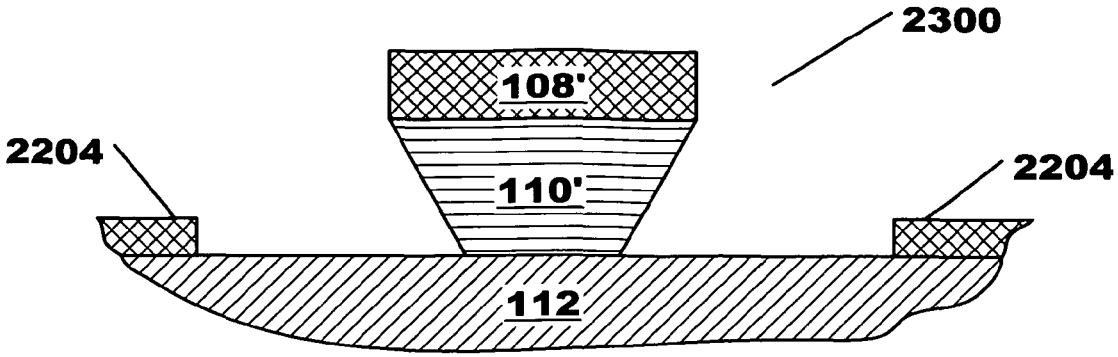
FIG. 23 is a partial cross section view of the structure of FIG. 22 subsequent to the lift-off of photo resist feature 2202, in accordance with an embodiment of the present invention.
Figure 24:
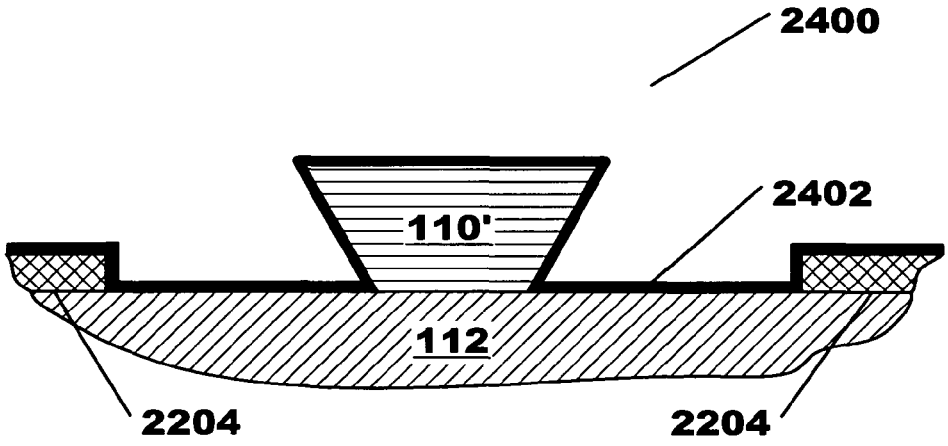
FIG. 24 is a partial cross section view of the structure of FIG. 23 subsequent to the removal of DLC layer 108' and the deposition of ultra-thin seed layer 2402, in accordance with an embodiment of the present invention.
Figure 25:
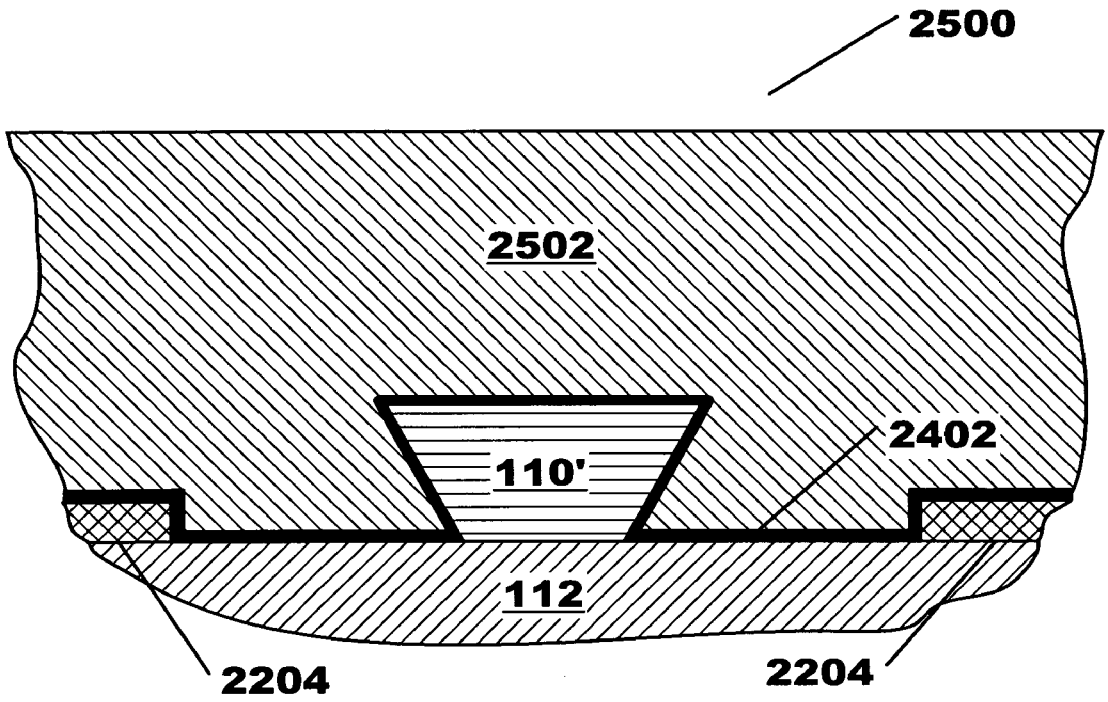
FIG. 25 is a partial cross section view of the structure of FIG. 24 subsequent to the electroplating of wrap around shield 2502, in accordance with an embodiment of the present invention.

Returning to FIG. 39, in step 3904, photo resist feature 2202 is produced by deposition, imaging, and development of a blanket photo resist layer. Patterns in accordance with FIG. 8*a*, 8*b*, or 8*c* can be utilized as previously disclosed. In step 3906, a blanket thick seed layer 2204 is deposited. Limitations and compositions of thick seed layer 2204 have been previously discussed. FIG. 22 is a partial cross section view 2200 of the structure of FIG. 21 subsequent to formation of photo resist feature 2202 and deposition of thick seed layer 2204, in accordance with an embodiment of the present invention. In step 3908, photo resist feature 2202 and a portion of thick seed layer 2204 is removed in a lift off process. DLC layer 108' (if present) is also removed in this step. FIG. 23 is a partial cross section view 2300 of the structure of FIG. 22 subsequent to the lift-off of photo resist feature 2202, and removal of DLC layer 108', in accordance with an embodiment of the present invention. In step 3910, ultra thin seed layer 2402 is blanket deposited. FIG. 24 is a partial cross section view 2400 of the structure of FIG. 23 subsequent to the removal of DLC layer 108' and the deposition of ultra-thin seed layer 2402, in accordance with an embodiment of the present invention. In step 3912, wrap around shield 2502 is deposited. FIG. 25 is a partial cross section view 2500 of the structure of FIG. 24 subsequent to the electroplating of wrap around shield 2502, in accordance with an embodiment of the present invention.

Figure 26:
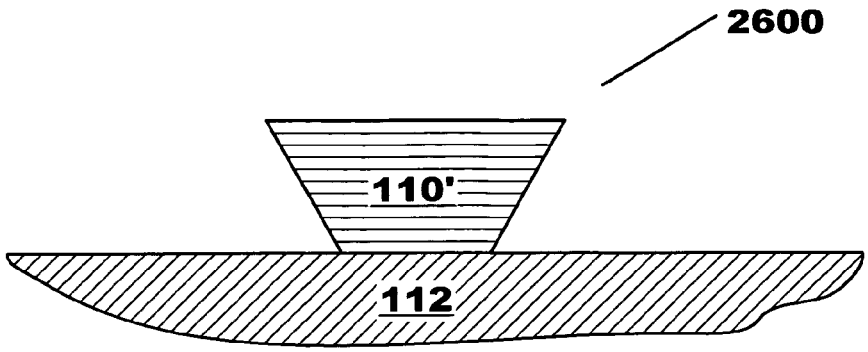
FIG. 26 is a partial cross section view of the structure of FIG. 21 subsequent to the removal of DLC layer 108', in accordance with an embodiment of the present invention.
Figure 27:
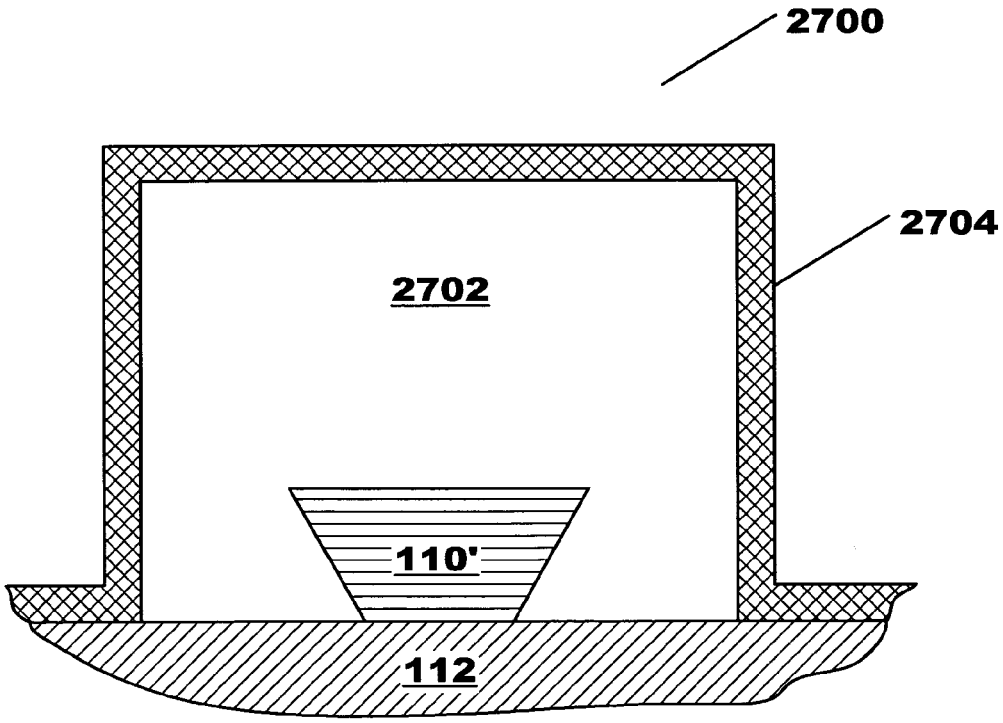
FIG. 27 is a partial cross section view of the structure of FIG. 26 subsequent to formation of photo resist feature 2702 and deposition of thick seed layer 2704, in accordance with an embodiment of the present invention.
Figure 28:
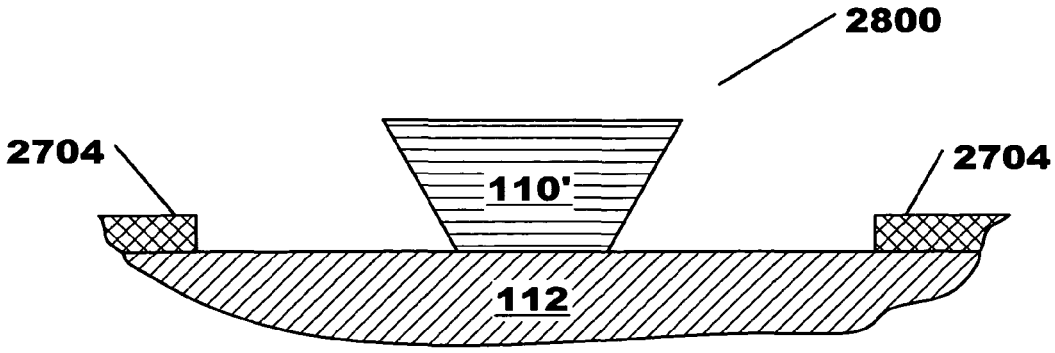
FIG. 28 is a partial cross section view of the structure of FIG. 27 subsequent to the lift-off of photo resist feature 2702, in accordance with an embodiment of the present invention.
Figure 29:
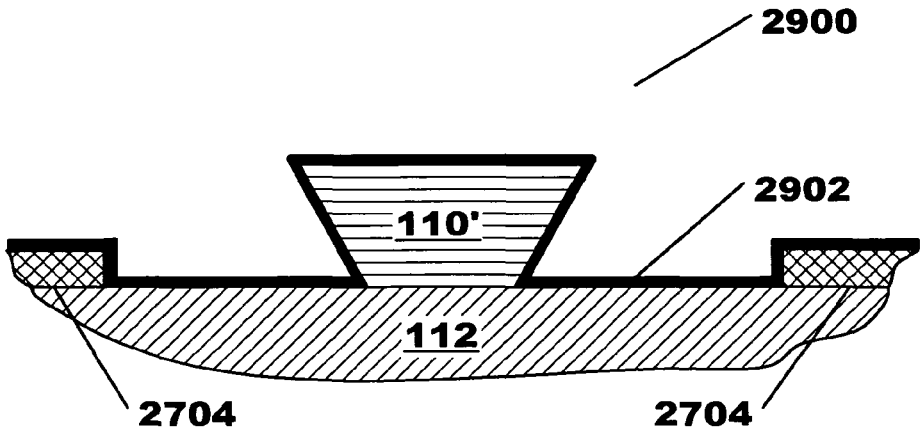
FIG. 29 is a partial cross section view of the structure of FIG. 23 subsequent to the deposition of ultra-thin seed layer 2902, in accordance with an embodiment of the present invention.

FIG. 40 is a block diagram 4000 of a fourth process to fabricate a wrap around shield, in accordance with an embodiment of the present invention. This process is a variant of the second process of FIG. 39, in that the DLC layer is removed prior to the deposition of the thick seed layer. This is done to reduce potential oxidation of the thick seed layer. The process begins at step 3702 of FIG. 37, and proceeds to step 3708 of FIG. 37, as previously disclosed. Durimide layer 106' is then removed as in step 3902 of FIG. 39. DLC layer 108' is then removed by oxidation in step 4002 of FIG. 40. FIG. 26 is a partial cross section view 2600 of the structure of FIG. 21 subsequent to the removal of DLC layer 108', in accordance with an embodiment of the present invention. In step 4004 of FIG. 40, photo resist feature 2702 is deposited, imaged and developed. Patterns in accordance with FIG. 8*a*, 8*b*, or 8*c* can be utilized as previously disclosed. In step 4006, a blanket thick seed layer 2704 is deposited. Limitations and compositions of thick seed layer 2704 have been previously discussed. FIG. 27 is a partial cross section view 2700 of the structure of FIG. 26 subsequent to formation of photo resist feature 2702 and deposition of thick seed layer 2704, in accordance with an embodiment of the present invention. In step 4008, photo resist feature 2702 and a portion of thick seed layer 2704 is removed in a lift off process. FIG. 28 is a partial cross section view 2800 of the structure of FIG. 27 subsequent to the lift-off of photo resist feature 2702, in accordance with an embodiment of the present invention. In step 4010, ultra thin seed layer 2902 is blanket deposited. FIG. 29 is a partial cross section view 2900 of the structure of FIG. 23 subsequent to the deposition of ultra-thin seed layer 2902, in accordance with an embodiment of the present invention. The wrap around shield is then plated as in step 3912 of FIG. 39.

Figure 30:
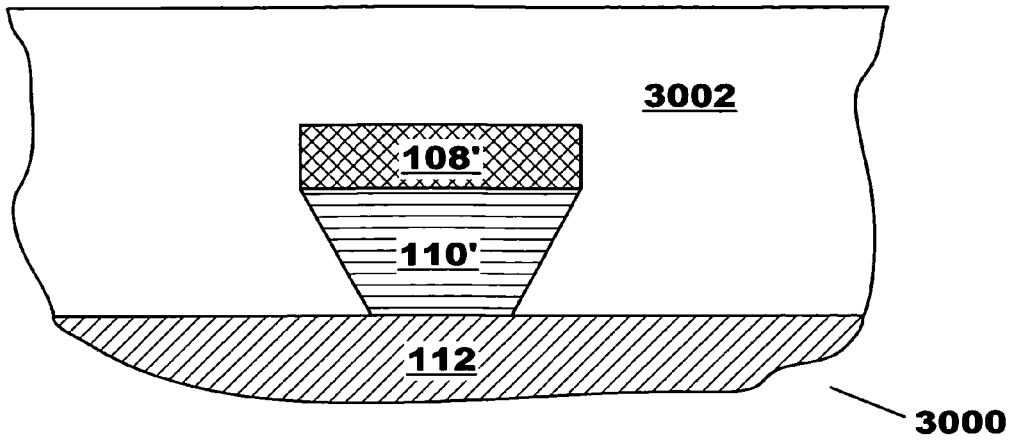
FIG. 30 is a partial cross section view of the structure of FIG. 21 subsequent to the deposition of spacer layer 3002, in accordance with an embodiment of the present invention.
Figure 31:
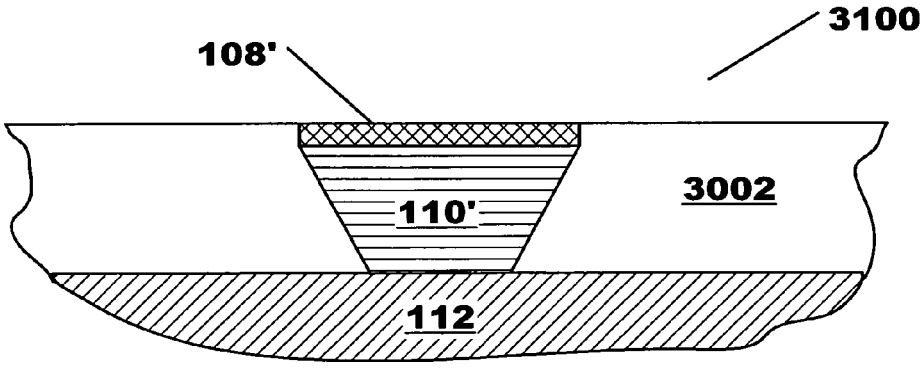
FIG. 31 is a partial cross section view of the structure of FIG. 30 subsequent to the planarization of spacer layer 3002, in accordance with an embodiment of the present invention.
Figure 32:
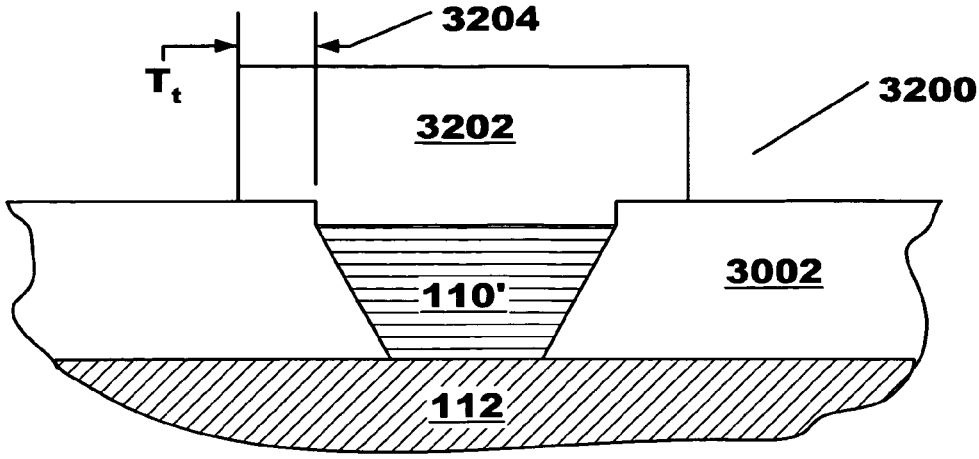
FIG. 32 is a partial cross section view of the structure of FIG. 31 subsequent to formation of photo resist feature 3202, in accordance with an embodiment of the present invention.
Figure 33:
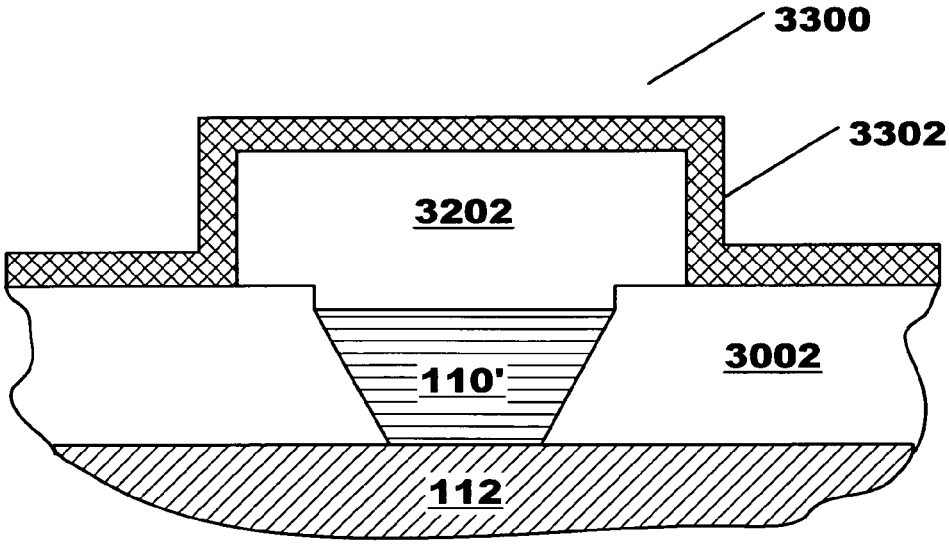
FIG. 33 is a partial cross section view of the structure of FIG. 32 subsequent to deposition of thick seed layer 3302, in accordance with an embodiment of the present invention.
Figure 34:
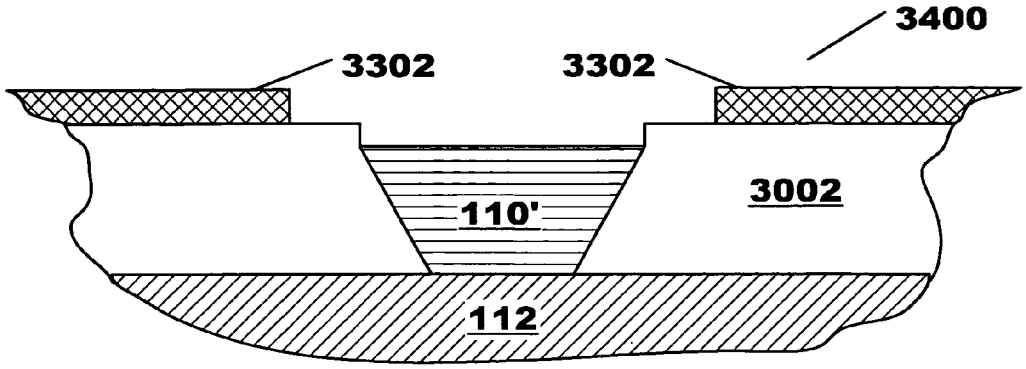
FIG. 34 is a partial cross section view of the structure of FIG. 33 subsequent to the lift-off of photo resist feature 3202, in accordance with an embodiment of the present invention.
Figure 35:
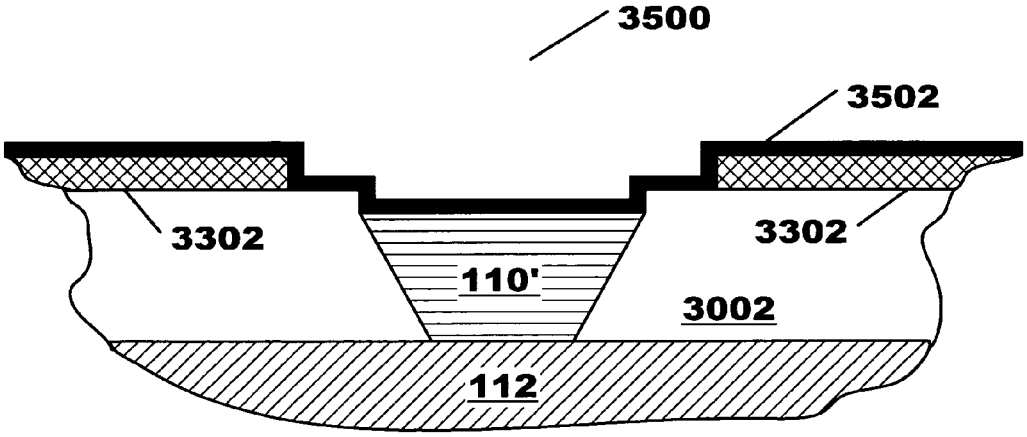
FIG. 35 is a partial cross section view of the structure of FIG. 34 subsequent to the deposition of ultra-thin seed layer 3502, in accordance with an embodiment of the present invention.

FIG. 41 is a block diagram 4100 of a process to fabricate a trailing shield, in accordance with an embodiment of the present invention. The process begins at step 3702 of FIG. 37, and proceeds to step 3708 of FIG. 37, as previously disclosed. Durimide layer 106' is then removed as in step 3902 of FIG. 39. In step 4102 of FIG. 41, a spacer layer 3002 is blanket deposited. FIG. 30 is a partial cross section view 3000 of the structure of FIG. 21 subsequent to the deposition of spacer layer 3002, in accordance with an embodiment of the present invention. In step 4104, the structure is planarized by CMP, utilizing DLC layer 108' as a stop layer. FIG. 31 is a partial cross section view 3100 of the structure of FIG. 30 subsequent to the planarization of spacer layer 3002, in accordance with an embodiment of the present invention. In step 4106, photo resist feature 3202 is produced by deposition, imaging, and development of a blanket photo resist layer. Patterns in accordance with FIG. 8*a*, 8*b*, or 8*c* can be utilized as previously disclosed. FIG. 32 is a partial cross section view 3200 of the structure of FIG. 31 subsequent to formation of photo resist feature 3202, in accordance with an embodiment of the present invention. Limitations on dimension $T_t$ (ref 3204) are similar to those discussed for $T_w$ (ref 704) above. In step 4108 of FIG. 41, thick seed layer 3302 is deposited. Limitations and compositions of thick seed layer 3302 have been previously discussed. FIG. 33 is a partial cross section view 3300 of the structure of FIG. 32 subsequent to deposition of thick seed layer 3302, in accordance with an embodiment of the present invention. In step 4110, photo resist feature 3202 and a portion of thick seed layer 3302 is removed in a lift off process. FIG. 34 is a partial cross section view 3400 of the structure of FIG. 33 subsequent to the lift-off of photo resist feature 3202, in accordance with an embodiment of the present invention. In step 4110 of FIG. 41, ultra thin seed layer 3502 is blanket deposited. FIG. 35 is a partial cross section view of the structure of FIG. 34 subsequent to the deposition of ultra-thin seed layer 3502, in accordance with an embodiment of the present invention. In step 4112, trailing shield 3602 is deposited. FIG. 36 is a partial cross section view 3600 of the structure of FIG. 34 subsequent to the electroplating of trailing shield 3602, in accordance with an embodiment of the present invention.

The present invention is not limited by the previous embodiments heretofore described. Rather, the scope of the present invention is to be defined by these descriptions taken together with the attached claims and their equivalents.

What is claimed is:

1. A method for making a perpendicular head comprising:

fabricating a write pole structure on a first portion of a surface, said write pole structure comprising a write pole layer;

fabricating a thick seed layer on a second portion of said surface, said thick seed layer having a boundary residing adjacent to said write pole structure, said boundary of said thick seed layer separated from said write pole structure by a distance T;

depositing an ultra-thin seed layer on said write pole layer, and on at least a portion of said thick seed layer, such that electrical continuity is established between said thick seed layer and said ultra-thin seed layer; and, electroplating a shield structure over said write pole layer by conducting electrical current from said thick seed layer to at least a portion of said ultra-thin seed layer, wherein said ultra-thin seed layer functions as a non-magnetic top gap between said write pole layer and said shield structure, said distance T being greater than a thickness of said thick seed layer, said distance T being less than 15 microns.

2. The method as recited in claim 1, wherein fabricating said thick seed layer further comprises:

enclosing at least a portion of said write pole structure within a photo-resist layer, subsequent to fabricating said write pole structure on said first portion of said surface;

depositing said thick seed layer on said photo resist layer and said second portion of said surface; and, removing said photo resist layer and a portion of said thick seed layer deposited thereon.

3. The method as recited in claim 2, wherein said write pole structure comprises a non-magnetic side gap layer bonded to said write pole layer, said ultra-thin seed layer being deposited over said non-magnetic side gap layer.

4. The method as recited in claim 3, wherein said write pole structure comprises a DLC layer, said DLC layer being removed subsequent to the removal of said photo resist layer.

5. The method as recited in claim 3, wherein said write pole structure comprises a DLC layer, said DLC layer being removed prior to deposition of said photo resist layer.

6. The method as recited in claim 3, wherein said shield structure is a wrap around shield.

7. The method as recited in claim 2, wherein said ultra-thin seed layer is deposited on said write pole layer such that said ultra-thin seed layer functions as both a top gap and side gap.

8. The method as recited in claim 7, wherein said write pole structure comprises a DLC layer, said DLC layer being removed prior to deposition of said photo resist layer.

9. The method as recited in claim 7, wherein said write pole structure comprises a DLC layer, said DLC layer being removed prior to deposition of said photo resist layer.

10. The method as recited in claim 7, wherein said shield structure is a wrap around shield.

11. The method as recited in claim 2, wherein said shield structure is a trailing shield.

12. The method as recited in claim 1, wherein distance T is less than 10 microns.

13. The method as recited in claim 1, wherein said thick seed layer is between 100 nm and 500 nm thick.

14. The method as recited in claim 13, wherein said thick seed layer is between 250 nm and 300 nm thick.

15. The method as recited in claim 1, wherein said ultra-thin seed layer is between 1 nm and 3 nm thick.

16. The method as recited in claim 15, wherein said ultra-thin seed layer comprises a noble metal.

17. A method for making a perpendicular head comprising:

fabricating a write pole structure on a first portion of a surface, said write pole structure comprising a write pole layer;

enclosing at least a portion of said write pole structure within a photo-resist layer, subsequent to fabricating said write pole structure on said first portion of said surface;

depositing a thick seed layer on said photo resist layer and said second portion of said surface, said thick seed layer having a thickness between 100 nm and 500 nm;

removing said photo resist layer and a portion of said thick seed layer deposited on said photo resist layer, creating a thick seed layer boundary adjacent to said write pole structure, said boundary of said thick seed layer separated from said write pole structure by a distance T;

depositing an ultra-thin seed layer on said write pole layer, and on at least a portion of said thick seed layer, such that electrical continuity is established between said thick seed layer and said ultra-thin seed layer, said ultra-thin seed layer having a thickness between 1 nm and 3 nm; and, electroplating a shield structure over said write pole layer by conducting electrical current from said thick seed layer to at least a portion of said ultra-thin seed layer, wherein said ultra-thin seed layer functions as a non-magnetic top gap between said write pole layer and said shield structure, said distance T being greater than said thickness of said thick seed layer, said distance T being less than 15 microns.

* * * * *